US006540015B1

(12) United States Patent
Kawachi et al.

(10) Patent No.: US 6,540,015 B1
(45) Date of Patent: Apr. 1, 2003

(54) HEAT EXCHANGER AND METHOD FOR MANUFACTURING THE SAME

(75) Inventors: Norihide Kawachi, Kariya (JP); Ken Yamamoto, Obu (JP); Takeshi Okinotani, Kariya (JP); Toshiya Kouga, Chiryu (JP); Toshihiro Imai, Nagoya (JP); Norimasa Baba, Toyoake (JP); Tomoaki Kobayakawa, Tokyo (JP); Kazutoshi Kusakari, Urawa (JP); Michiyuki Saikawa, Zushi (JP)

(73) Assignees: Denso Corporation, Kariya (JP); Tokyo Electric Power Company, Tokyo (JP); Central Research Institute of Electric Power Industry, Tokyo (JP)

( * ) Notice: Subject to any disclaimer, the term of this patent is extended or adjusted under 35 U.S.C. 154(b) by 0 days.

(21) Appl. No.: 09/662,216

(22) Filed: Sep. 14, 2000

(30) Foreign Application Priority Data

| | | |
|---|---|---|
| Sep. 16, 1999 | (JP) | 11-261457 |
| Jan. 19, 2000 | (JP) | 2000-009646 |
| May 16, 2000 | (JP) | 2000-143202 |
| May 16, 2000 | (JP) | 2000-143203 |
| Jul. 14, 2000 | (JP) | 2000-214570 |
| Jul. 14, 2000 | (JP) | 2000-214900 |

(51) Int. Cl.[7] ..... F28D 7/16
(52) U.S. Cl. ..... 165/164; 165/140; 165/906
(58) Field of Search ..... 165/164, 140, 165/906

(56) References Cited

U.S. PATENT DOCUMENTS

| | | | | | |
|---|---|---|---|---|---|
| 1,720,768 | A | * | 7/1929 | Spreen | 165/140 X |
| 2,268,730 | A | * | 1/1942 | Vagt | 165/140 |
| 2,284,915 | A | * | 6/1942 | Miller | 165/164 |
| 2,308,762 | A | * | 1/1943 | Krug et al. | 165/140 |
| 2,879,050 | A | * | 3/1959 | Folger | 165/164 X |
| 3,153,446 | A | * | 10/1964 | Shaw | 165/164 |
| 3,414,052 | A | * | 12/1968 | Chojnowski et al. | 165/164 |
| 5,186,242 | A | * | 2/1993 | Adachi et al. | 165/140 X |
| 5,875,837 | A | * | 3/1999 | Hughes | 165/140 |

FOREIGN PATENT DOCUMENTS

| | | |
|---|---|---|
| JP | 5-196377 | 8/1993 |

* cited by examiner

*Primary Examiner*—Leonard Leo
(74) *Attorney, Agent, or Firm*—Harness, Dickey & Pierce, PLC

(57) ABSTRACT

A heat exchanger includes a first tube in which water flows and a second tube in which refrigerant flows, and performs heat exchange between water and refrigerant. The first tube and the second tube are bonded to each other by brazing at joint surfaces thereof such that water flow crosses refrigerant flow perpendicularly. The joint surface of the first tube is divided into several surface regions by grooves. Accordingly, the joint surface of the first tube can be brazed to the joint surface of the second tube uniformly.

41 Claims, 34 Drawing Sheets

FIG. 7
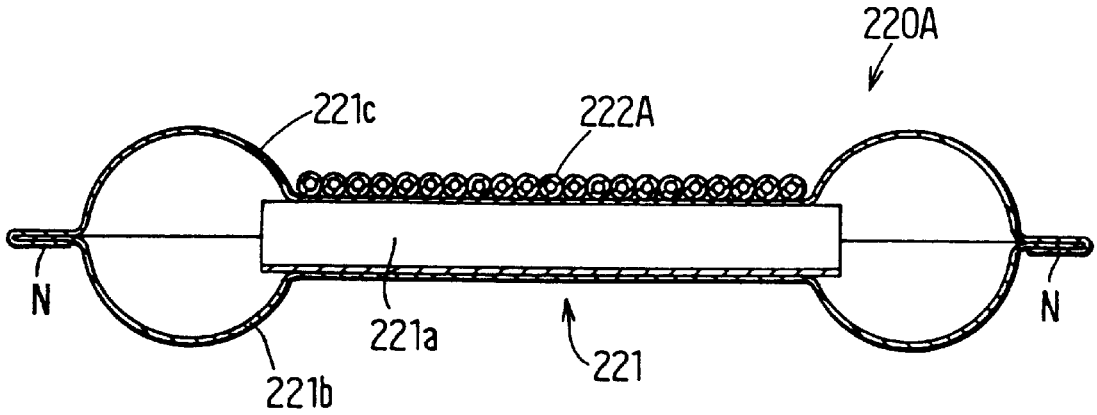
FIG. 8B FIG. 8D
FIG. 8A FIG. 8C
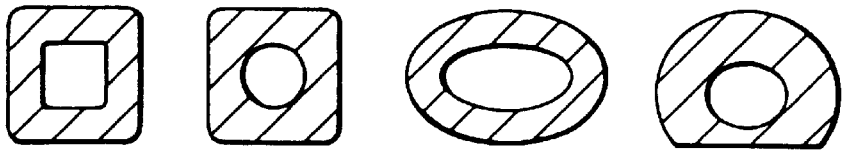

HEAT EXCHANGER AND METHOD FOR MANUFACTURING THE SAME

CROSS REFERENCE TO RELATED APPLICATIONS

This application is based upon and claims the benefit of Japanese Patent Applications No. 11-261457 filed on Sep. 16, 1999, No. 2000-9646 filed on Jan. 19, 2000, No. 2000-143202 filed on May 16, 2000, No. 2000-143203 filed on May 16, 2000, No. 2000-214570 filed on Jul. 14, 2000, and No. 2000-214900 filed on Jul. 14, 2000.

BACKGROUND OF THE INVENTION

1. Field of the Invention

This invention relates to a heat exchanger including two kinds of tubes joined to each other for performing heat-exchange between fluids respectively flowing in the tubes, and to a method for manufacturing the same.

2. Description of the Related Art

JP-A-5-196377 proposes a heat exchanger including two flat tubes that respectively have plural fluid passages therein and are thermally joined to each other by brazing or soldering at an entire region in a longitudinal direction thereof. In this heat exchanger, heat is transmitted from fluid (for instance; refrigerant) flowing in one of the tubes to fluid (for instance, water) flowing in the other one of the tubes.

SUMMARY OF THE INVENTION

An object of the present invention is to provide a heat exchanger including two tubes for exchanging heat between fluids flowing therein with high heat exchanging efficiency.

According to one aspect of the present invention, a heat exchanger has a first tube defining therein a first fluid passage in which first fluid flows, and a second tube contacting the first tube and defining therein a second fluid passage in which second fluid flows. The first tube has a first joint surface brazed to a second joint surface of the second tube. A groove is provided on the first joint surface to divide the first joint surface into at least two regions such that the first joint surface is brazed to the second joint surface at the regions other than the groove. Accordingly, the first joint surface and the second joint surface can be brazed to each other uniformly without producing large voids therebetween. This prevents deterioration of heat exchanging efficiency of the heat exchanger.

According to another aspect of the present invention, a first tube is composed of a plurality of first tube bodies that are disposed in parallel with each other such that first fluid flows in the plurality of first tube bodies with a serpentine path, and such that the first fluid flows in each of the plurality of first tube bodies in a first fluid direction approximately perpendicular to a second fluid direction in which second fluid flows a second tube.

Preferably, the plurality of first tube bodies are arranged in a direction perpendicular to a longitudinal direction thereof and perpendicular to a longitudinal direction of the second tube. Preferably, the second tube meanders to extend in the direction in which the plurality of first tube bodies are arranged and to have a plurality of second tube portions each extending in the second fluid direction such that the second fluid flows in each of the plurality of second tube portions in the second fluid direction to form a serpentine path.

Accordingly, the first fluid flowing in the first tube and the second fluid flowing in the second tube can exchange heat therebetween effectively. Further, the heat exchanger can be provided with a compact size.

BRIEF DESCRIPTION OF THE DRAWINGS

Other objects and features of the present invention will become more readily apparent from a better understanding of the preferred embodiments described below with reference to the following drawings, in which;

FIG. 7 is a cross-sectional view showing tubes of a heat exchanger in a third preferred embodiment, taken along a line corresponding to line VII—VII in FIG. 3A;

FIGS. 8A to 8D are cross-sectional views of capillary tubes as modifications of the third embodiment;

DETAILED DESCRIPTION OF THE PREFERRED EMBODIMENTS

First Embodiment

Figure 1:
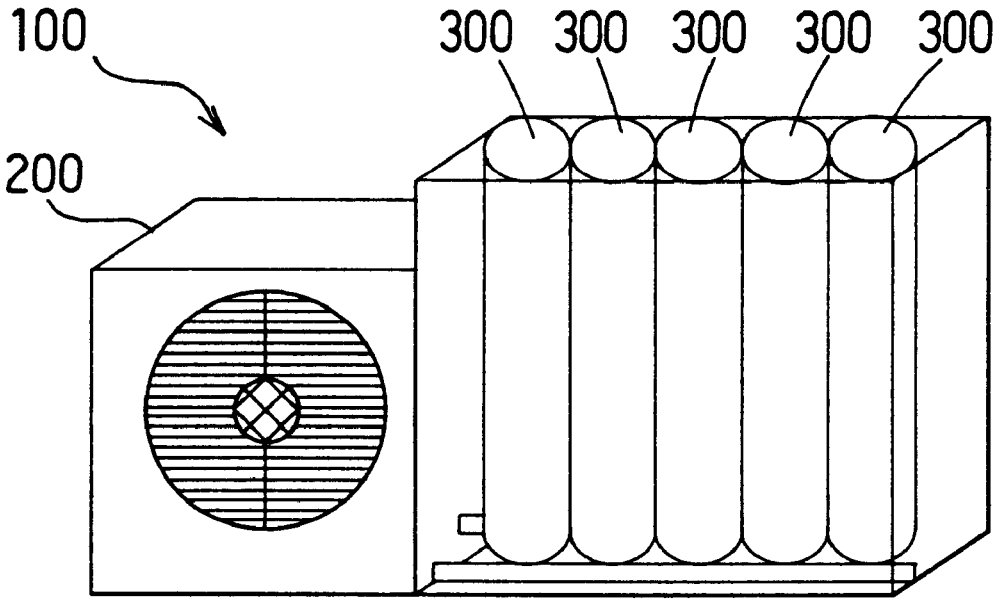
FIG. 1 is a schematic perspective view showing a contour of a hot-water supply system in a first preferred embodiment of the present invention.

In a first preferred embodiment, a heat exchanger according to the present invention is applied to a domestic hot-water supply system. FIG. 1 is an outside drawing of the hot-water supply system 100, and FIG. 2 is a schematic view of the hot water supply system 100.

Figure 2:
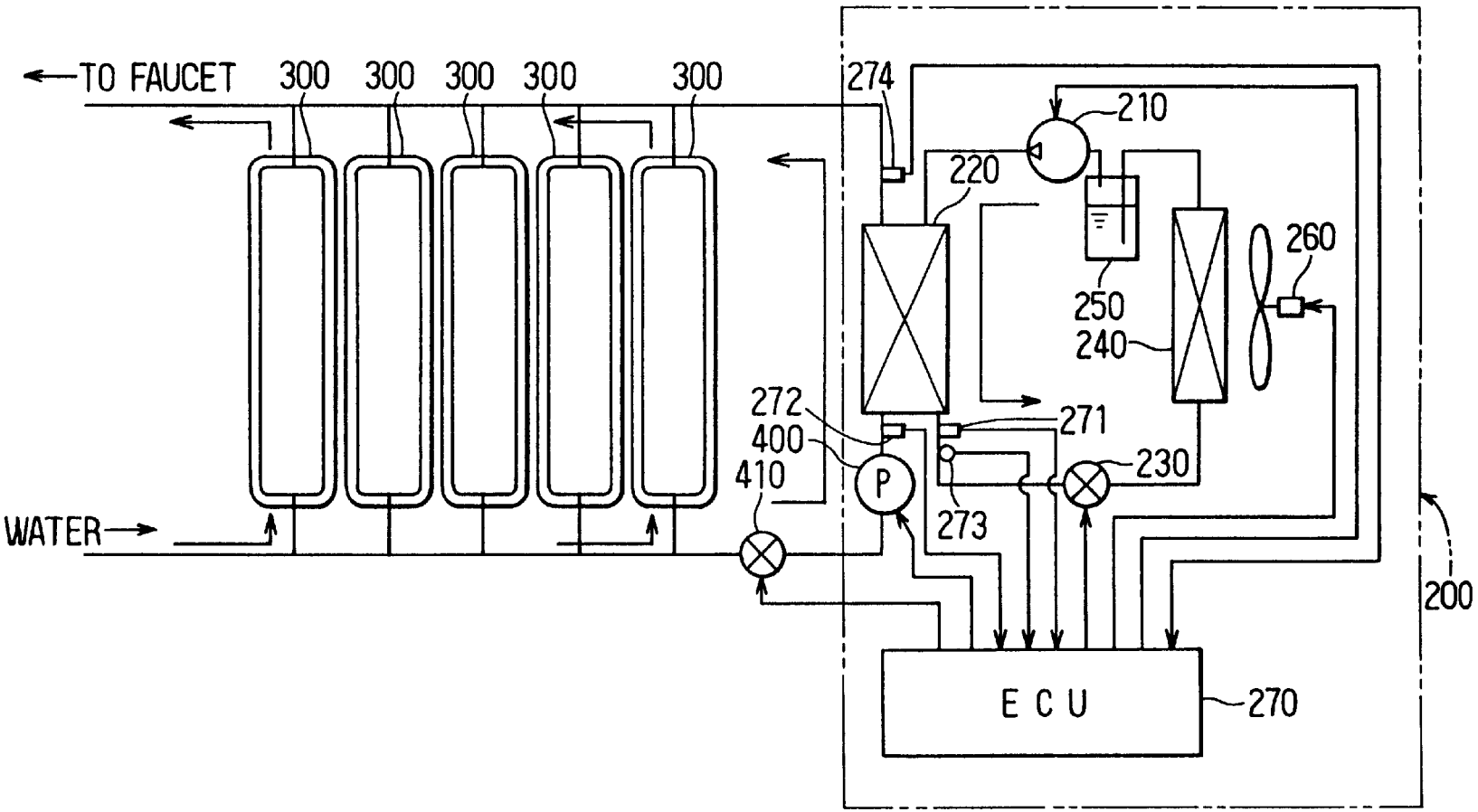
FIG. 2 is a schematic diagram showing the hot-water supply system in the first embodiment.

In FIG. 2, reference numeral 200 (part surrounded by two-dot chain lines) indicates a super critical heat pump cycle (hereinafter, referred to as a heat pump) for heating water (service water) to produce hot water with a high temperature (about 85° C. in the present embodiment). The super critical heat pump cycle is a heat pump cycle in which pressure of refrigerant exceeds a critical pressure at a high pressure side. The heat pump uses refrigerant such as carbon dioxide, ethylene, ethane, or nitrogen oxide. Several thermal insulation tanks 300 for storing hot water heated by the heat pump 200 are provided in parallel with respect to a flow of hot water (hot water to be supplied).

The heat pump 200 has a compressor 210 for compressing refrigerant (carbon dioxide in the present embodiment), and a water heat exchanger (Gas cooler) 220 for exchanging heat between refrigerant, which is discharged from the compressor 210, and supplied water. The compressor 210 is an electrically driven compressor integrally composed of a compression unit (not shown) for sucking and compressing refrigerant, and an electric motor (not shown) for driving the compression unit. The water heat exchanger is a heat exchanger to which the present invention is applied in the present embodiment.

Figure 3A:
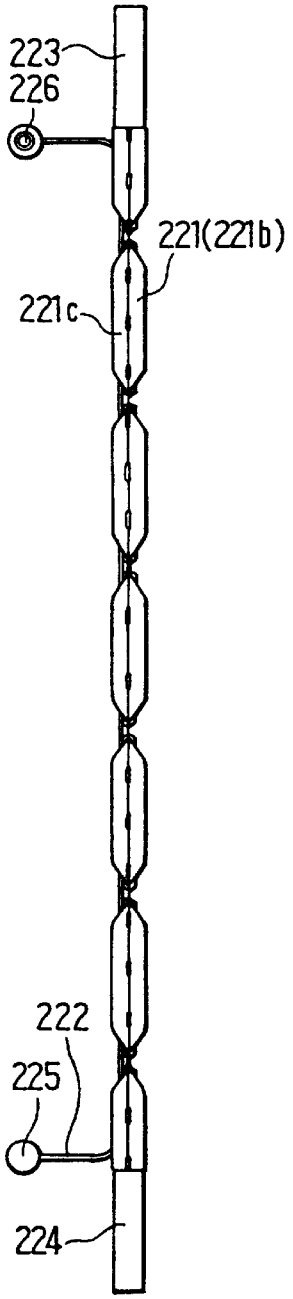
FIG. 3A is a side view showing a water heat exchanger in the first embodiment.
Figure 3B:
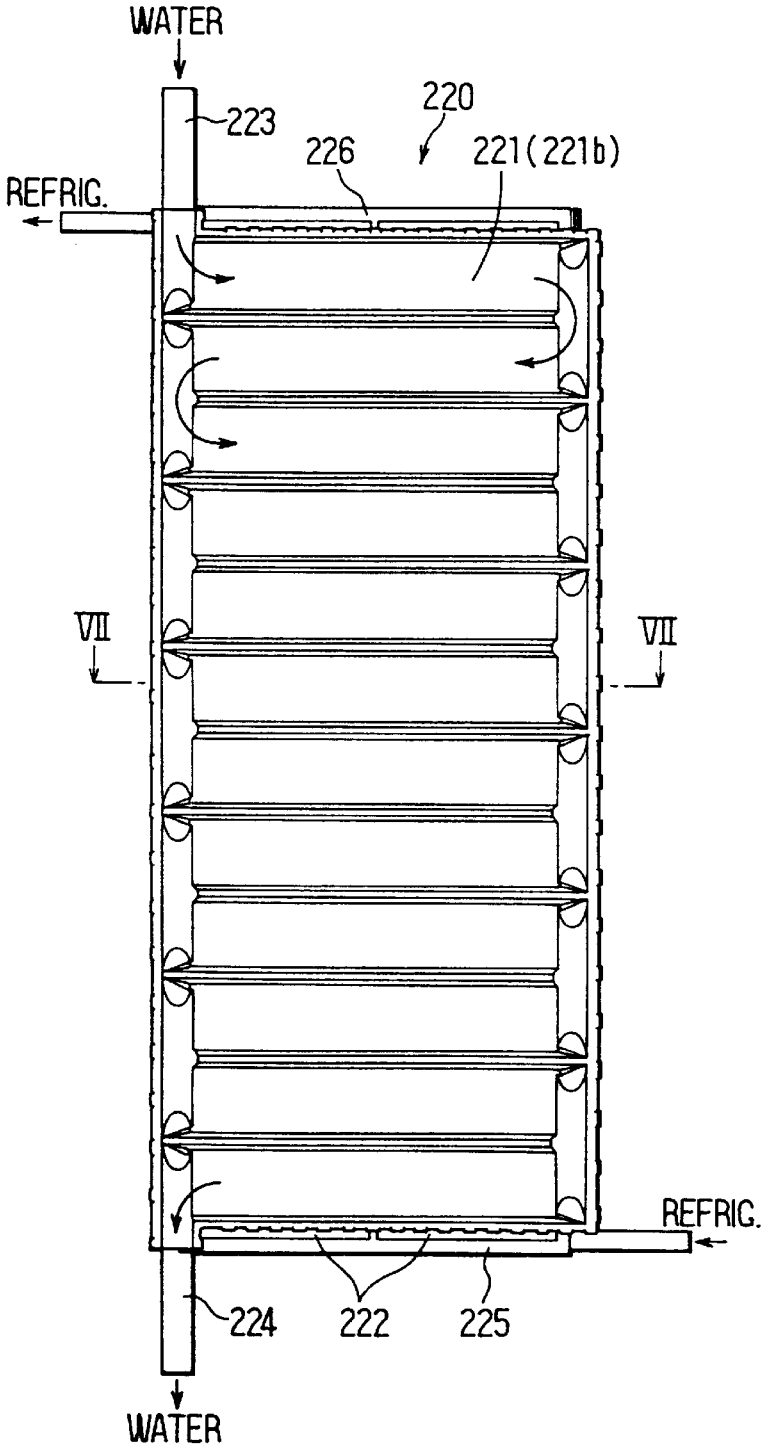
FIG. 3B is a front view showing the water heat exchanger shown in FIG. 3A.

Specifically, as shown in FIGS. 3A and 3B, the heat exchanger 220 is an opposed flow type heat exchanger, which is constructed such that a flow of water (supplied water) flowing in a first tube 221 is opposed to a flow of refrigerant flowing in several second tubes 222 disposed in contact with the first tube 221. Water is supplied to the first tube 221 from a pipe 223, flows in the first tube 221, and collected by a pipe 224. Refrigerant is distributed into the several second tubes 222 by a first header tank 225, flows in the second tubes 222, and collected by a second header tank 226.

Figure 4A:
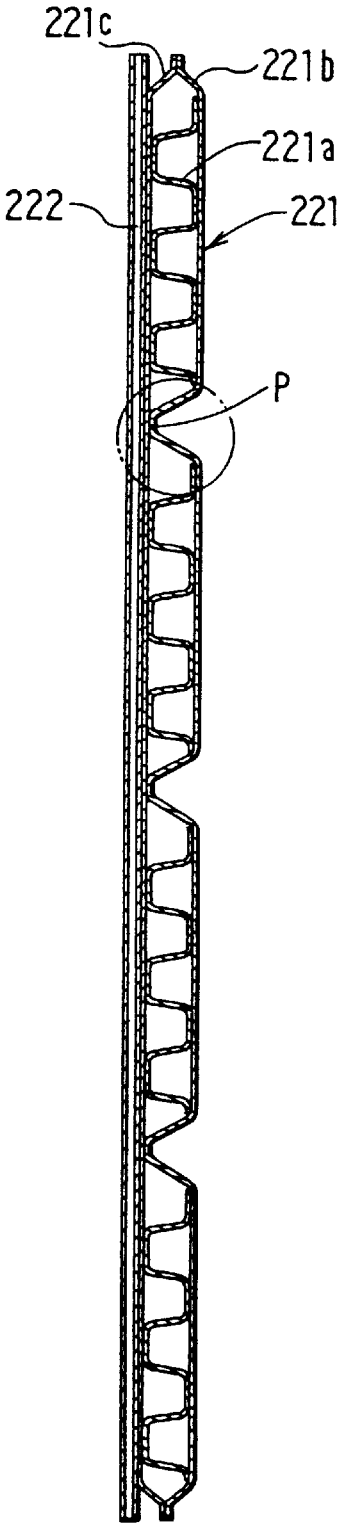
FIG. 4A is a cross-sectional view showing a prototype tube of the water heat exchanger.
Figure 4B:
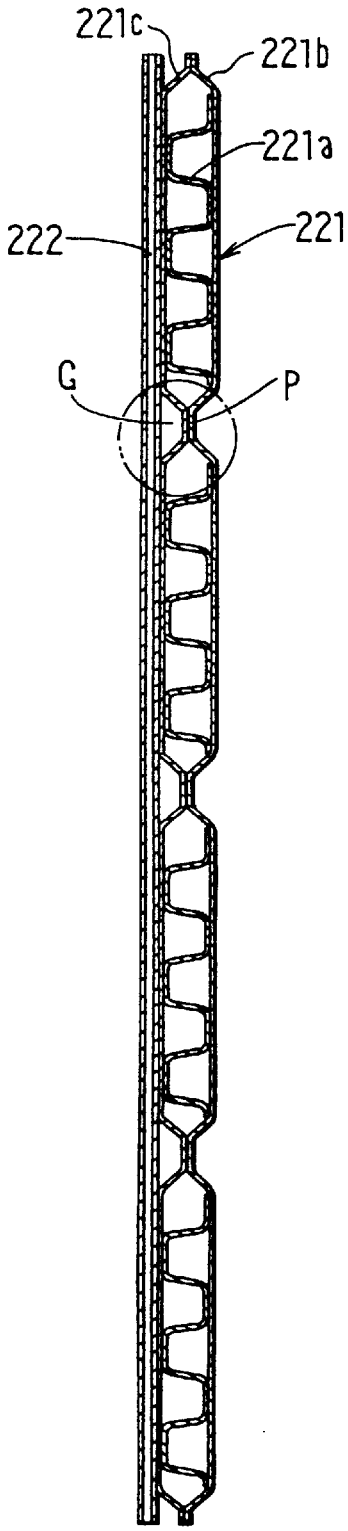
FIG. 4B is a cross-sectional view showing a tube of the water heat exchanger according to the first embodiment.

As shown in FIG. 4B, the first tube 221 and the second tubes 222 are flat. The first tube 221 is composed of copper-made plate members 221*b*, 221*c*, and a copper-made corrugated inner fin 221*a* interposed between the plate members 221*b*, 221*c*. A surface of the plate member 221*c* is clad with stainless. The inner fin 221, and the plate members 221*b*, 221*c* are integrally brazed to one another. Each of the second tubes 222 is made of aluminum, and formed by extrusion or drawing. The tubes 221 and 222 are joined to one another by brazing such that those longitudinal directions correspond to each other.

Incidentally, referring back to FIG. 2, the heat pump 200 has an electric expansion valve (pressure-reducing device) 230 for decompressing refrigerant discharged from the water heat exchanger 220, an evaporator 240 for making refrigerant, which is discharged from the expansion valve 230, absorb heat of atmospheric air by evaporating refrigerant, and an accumulator 250 provided at a suction side of the compressor 210. The accumulator 250 separates refrigerant, which is discharged from the evaporator 240, into gaseous phase refrigerant and liquid phase refrigerant, conducts gaseous phase refrigerant into the compressor 210, and accumulates surplus refrigerant for the heat pump 200 therein. The heat pump 200 further has a blower (air amount controlling member) for controlling an amount of air (outside air) blown toward the evaporator 240. An electronic control unit (ECU) 270 controls the blower 260, the compressor 210, and the expansion valve 230 based on detection signals of various sensors described below.

A refrigerant temperature sensor 271 is provided to detect a temperature of refrigerant discharged from the water heat exchanger 220, and a first water temperature sensor 272 is provided to detect a temperature of water that is to flow into the water heat exchanger 220. A refrigerant pressure sensor 273 is provided to detect a pressure of refrigerant (high-pressure side refrigerant pressure) discharged from the water heat exchanger 220. A second water temperature sensor 274 is provided to detect a temperature of water discharged from the water heat exchanger 220. The detection signals of the sensors 271 to 274 are inputted into the ECU 270.

Here, the high-pressure side refrigerant pressure is a pressure of refrigerant flowing in a refrigerant passage extending between the discharge side of the compressor 210 and the inflow side of the expansion valve 230, and approximately equal to a discharge pressure of the compressor 210 (internal pressure of the water heat exchanger 220). On the other hand, a low-pressure side refrigerant pressure is a pressure flowing in a refrigerant passage extending between the outflow side of the expansion valve 230 and the suction side of the compressor 210, and approximately equal to a suction pressure of the compressor 210 (internal pressure of the evaporator 240).

Further, an electrically driven water pump 400 is provided to supply (circulate) water to the water heat exchanger 220 while controlling an amount of water. A shut-off valve 410 is provided to stop service water from flowing from a water line into the water heat exchanger 220. The ECU 270 controls the pump 400 and the shut-off valve 410.

Next, a method for manufacturing the water heat exchanger 200 according to the first embodiment is explained below. First, the inner fin 221*a* and the pipes 223 and 224 are set on the plate member 221*b*, and the plate member 221*c* is disposed thereon. Claws provided at edge portions of the plate member 221*b* are bent and caulked to assemble the first tube 221 (temporarily assembling step). In this step, brazing filler metal is coated on both surfaces of the inner fin 221*a* and the bonding surfaces of the plate members 221*b* and 221*c*.

This temporarily assembled first tube 221 is heated for a specific period of time within a furnace while being pinched by two pieces of jigs, thereby being integrally joined by brazing (phosphor copper brazing step).

Next, the second tubes 222, the header tanks 225, 226, and the like are temporarily assembled on the first tube 221 one after another. After that, these parts are temporarily fixed together using a temporarily fixing jig such as a wire (temporarily assembling step). Then, the temporarily assembled body is heated for a specific period of time within a furnace so that it is integrally joined to one another by brazing (non-corrosive flux brazing step). In the present embodiment, the brazing filler metal is aluminum (A4343), and applied to the outer walls of the tube members by cladding, coating, spraying, sheet or the like.

Next, features of the present embodiment are described specifically. FIG. 4A is a cross-sectional view showing a first prototype of the water heat exchanger 220, and FIG. 4B is a cross-sectional view showing the water heat exchanger 220 according to the present embodiment. In the present embodiment, grooves G are provided on the joint surface between the tubes 221 and 222 to divide the joint surface into several joint surfaces.

Accordingly, when the two flat tubes 221 and 222 are joined at an entire region in the longitudinal direction thereof, since the joint surface is divided into the several joint surfaces by the grooves G, variation in clearance of the joint surface is determined by each divided joint surface, and therefore decreased as compared to a case where the joint surface is not divided by grooves or the like.

In the case where the joint surface is not divided and the flat tubes 221, 222 are joined to each other at the entire region, brazing filler metal melts and gathers at a portion where the clearance is small due to a capillary phenomenon, and accordingly, large voids are produced at non-brazed portions where the clearance is large. This results in large brazing variation at the entire region, and deterioration in heat exchanging capability.

As opposed to this, according to the present embodiment, even if brazing filler metal melts and flows into a joint portion where the clearance is small to produce voids at another joint portion where the clearance is large, such variation is produced in each divided joint surface. Therefore, the brazing state on the joint surface as a whole is generally uniform, and a brazing area can be secured.

The grooves G are formed by bonding portions P between the two plate members 221*b* and 221*c* of the first tube 221. The bonding portions P are provided as partition portions to make the fluid passage in the first tube 221 meander (serpentine) several times. Since the bonding portions P do not contribute to heat exchange with the second tubes 222, the grooves G formed by the bonding portions P do not decrease a substantial heat exchanging area of the heat exchanger.

Second Embodiment

Figure 5A:
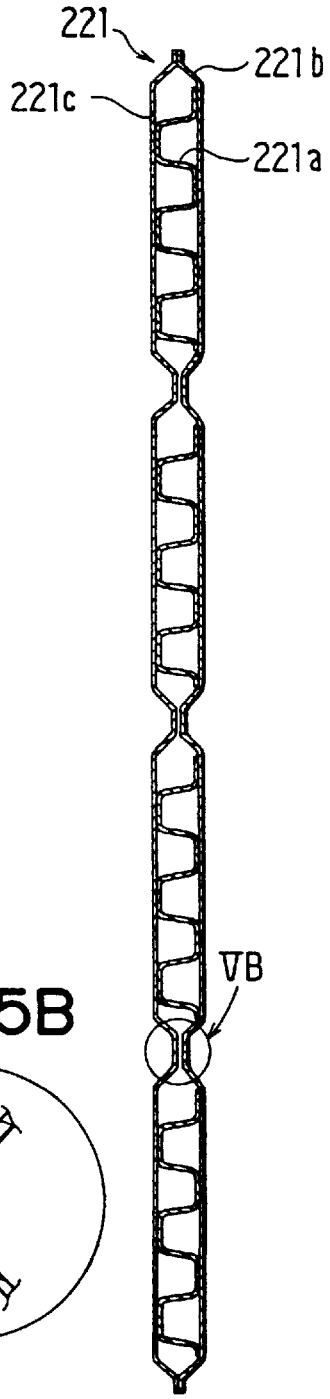
FIG. 5A is across-sectional view showing a first tube before pressing in a second preferred embodiment.
Figure 5B:
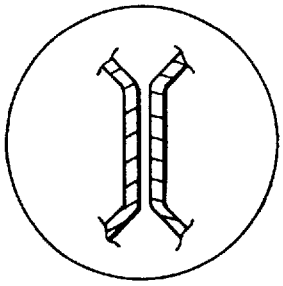
FIG. 5B is an enlarged cross-sectional view showing a part indicated by an arrow $V_B$ in FIG. 5A.
Figure 6A:
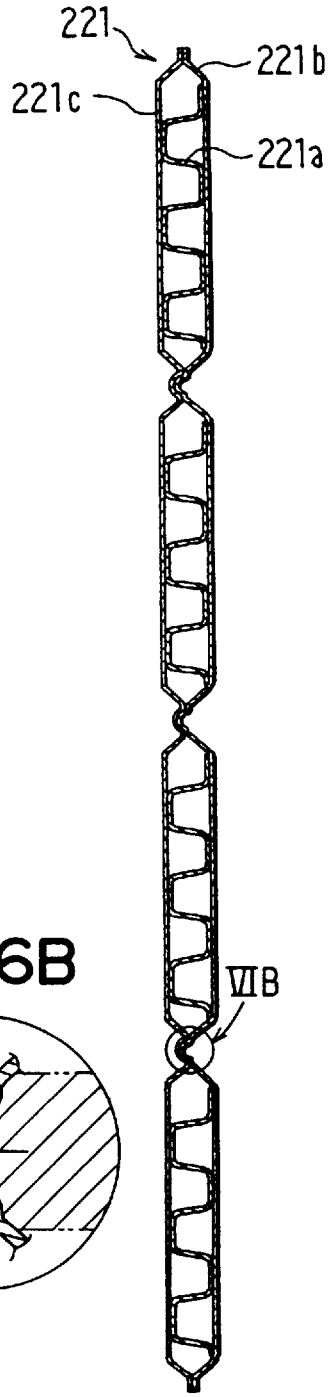
FIG. 6A is a cross-sectional view showing the first tube after pressing in the second embodiment.
Figure 6B:
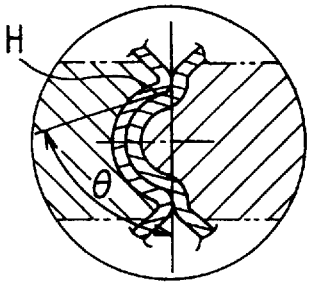
FIG. 6B is an enlarged cross-sectional view showing a part indicated by an arrow $VI_B$ in FIG. 6A.

FIGS. 5A and 5B are cross-sectional views showing the first tube 221 before pressing, and FIGS. 6A and 6B are cross-sectional views showing the first tube 221 after pressing in a second preferred embodiment. In the second embodiment, the plate members 221*b*, 221*c* have a contact wall portion H at each bonding portion P. The plate members 221*b*, 221*c* contact each other at the contact wall portion H that makes an angle θ with entire bonding surfaces, i.e., with a plane parallel to the main flat surfaces of the plate members 221*b*, 221*c* forming the fluid passage therein.

Thus, the bonding portion P is formed not by bonding simple flat walls but by bonding the concave and convex wall portions with respect to the plane parallel to the main flat surfaces of the plate members 221*b*, 221*c*. Accordingly, even when a large clearance is produced between the plate members 221*b* and 221*c*, the bonding portion P do no have such large clearance. The bonding portion P can be brazed uniformly with a sufficient brazing area not to cause internal leakages.

As a method for producing the first tube 221 in the second embodiment, when the plate members 221*b*, 221*c* are bonded to each other, each of the bonding portions P is pressurized to be plastically deformed until it has the concave and convex walls. After that, the plate members 221*b*, 221*c* are brazed together. That is, after the first tube 221 is temporarily assembled, the bonding portion P is pressurized by pressing or the like to form the contact wall portion H making a specific angle with the plane parallel to the main flat surfaces as described above.

For instance, brazing jigs may be used as press dies to form the bonding portion P under pressure. The plate members can be brazed with the jigs contacting the bonding portion P. Accordingly, the bonding portion P can be brazed uniformly while keeping its closely contacting state to suppress the clearance at the joint surfaces. The bonding portion P can provide a sufficient brazing area and prevent the occurrence of internal leakages. In the second embodiment, the contact wall portion H provided at the bonding portion P has a semi-circular shape. However, the shape is not limited to that, but may be other shapes such as an angular shape.

Third Embodiment

In the first and second embodiments, the second tubes 222 are made of aluminum. In a third preferred embodiment, a second tubes 222A are constructed by arranging plural capillary tubes made of copper. The plural second tubes 222A are joined together by brazing such that those longitudinal directions correspond to one another.

The method for manufacturing a heat exchanger 220A in the third embodiment is briefly explained below referring to FIG. 7, although it partially overlaps with that in the first embodiment. It should be noted that FIG. 7 is a cross-sectional view showing the heat exchanger 220A taken along a line corresponding to line VII—VII in FIG. 3B. In FIG. 7, the same parts as those in the first embodiment are indicated with the same reference numerals.

First, the inner fin 221*a*, the pipes 223, 224, and the like are put on the plate member 221*b*, and the plate member 221*c* is disposed thereon. After that, claws N provided at the edge portions of the plate member 221*c* are bent and caulked to assemble the first tube 221 temporarily. Further, parts such as the plural second tubes 222A, and the header tanks 225, 226 are assembled temporarily one after another on the temporarily assembled first tube 221. These parts are pitched by two jigs, and are temporarily fixed together while being pressurized by wires or the like (temporarily assembling step).

At that time, brazing filler metal for copper is applied to the both surfaces of the inner fin 221*a*, the joint surfaces of the plate members 221*b*, 221*c*, and the outer walls of the capillary tubes 222A. Then, the temporarily assembled body is heated within a furnace for a specific period of time, so that it is bonded together by brazing (brazing step). In the present embodiment, the brazing filler metal is applied to the surfaces of the parts, it may be disposed on the surfaces by cladding or spraying. Otherwise, it may be disposed on the surfaces as foils.

Next, the effects and features of the third embodiment are explained more specifically.

In the third embodiment, both the first tube 221 and the second tubes 222A are made of copper, the same material. The first tube 221 is formed not by extrusion but by joining the two plate members 221*b*, 221*c* together. Accordingly, an area of the passage defined in the first tube 221 can be made large, thereby preventing clogging therein. Further, the plate members 221*b*, 221*c* have high corrosion resistance to service water and the like since they are made of copper.

Since the first tube 221 and the second tubes 222A are made of the same material, the bonding between the two plate members 221*b*, 221*c* for forming the first tube 221 and the bonding between the first tube 221 and the second tubes 222A can be performed simultaneously. Only one brazing work is sufficient to bond (join) the plate members 221*b*, 221*c*, and to join the first tube 221 and the second tubes 222A, resulting in decreased working man-hour and shortened lead time of the product. Further, one kind of brazing jig is sufficient in this embodiment, resulting in simplification of the manufacturing process and low cost of the product.

Since the tubes 221 and 222A are made of the same material, there is no possibility to cause galvanic corrosion (electric corrosion), resulting in improvement of corrosion property. The second tubes 222A are formed by the plural capillary tubes and form passages therein for fluid such as refrigerant. The second tubes 222A can easily match its material to that of the first tube 221 by selecting the material of the capillary tubes.

In the third embodiment, it is explained that both the first tube 221 and the second tubes 222A are made of copper. However, both the first tube 221 and the second tubes 222A may be made of stainless to provide the same effects as described above.

FIGS. 8A to 8D exemplarily show cross-sectional shapes of the capillary tubes 222A as modifications of the third embodiment. Thus, the shape of each capillary tube is not limited to a circle, but may be other shapes such as a rectangle. The other features and effects are the same as those in the first and second embodiments.

Fourth Embodiment

A fourth preferred embodiment according to the present invention is directed to an arrangement of the heat exchanger 200 in the hot-water supply system 200.

Figure 9A:
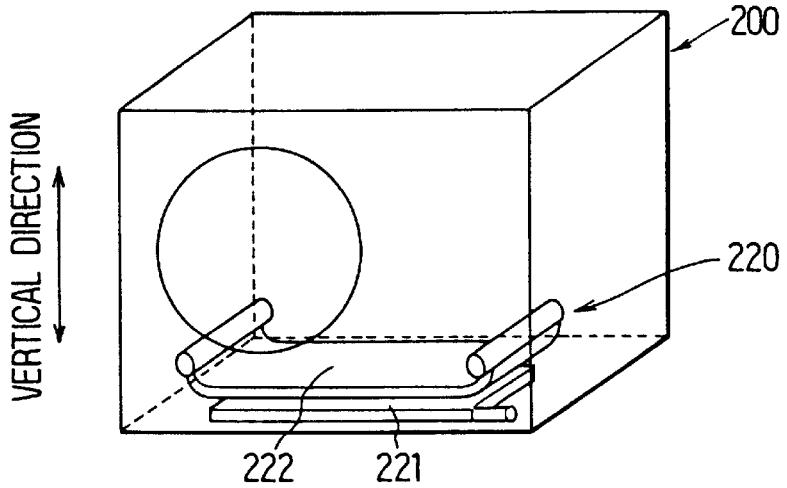
FIG. 9A is an arrangement of a heat exchanger in a hot-water supply system as a comparative example of a fourth preferred embodiment.

Specifically, it is assumed that the heat exchanger 220 is positioned in a body of the hot-water supply system 200 such that the first tube 221 is disposed under the second tube 222 in a vertical direction as shown in FIG. 9A. In the first fluid 221 in which fluid such as water flows to be heated by fluid such as refrigerant flowing in the second tube 222, part of water is heated to expand with a lightened relative density, and produces an opposed flow in the vertical direction. The heated water having a higher temperature flows at the upper side within the passage, while the other part of water having a lower temperature flows at the lower side within the passage. Accordingly, when the heat exchanger 200 is positioned as shown in FIG. 9A, it is difficult to perform heat-exchange between water having the lower temperature and refrigerant, resulting in low heat exchanging efficiency.

Figure 9B:
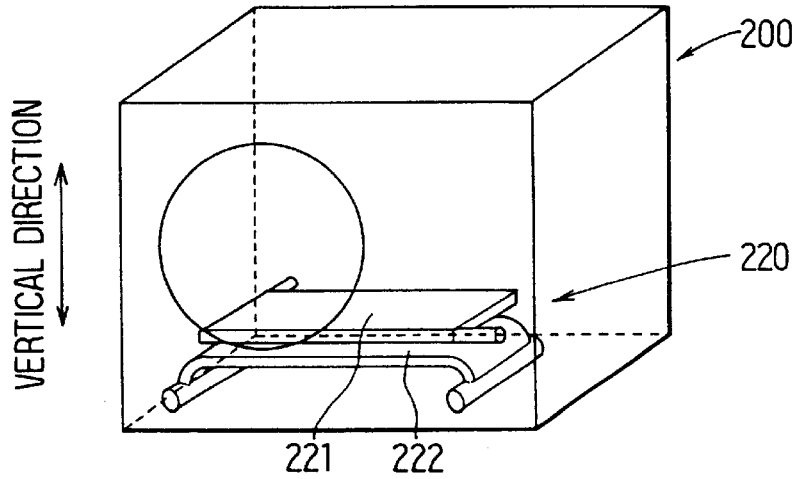
FIGS. 9B and 9C are arrangements of a heat exchanger in a hot-water supply system in the fourth embodiment.
Figure 9C:
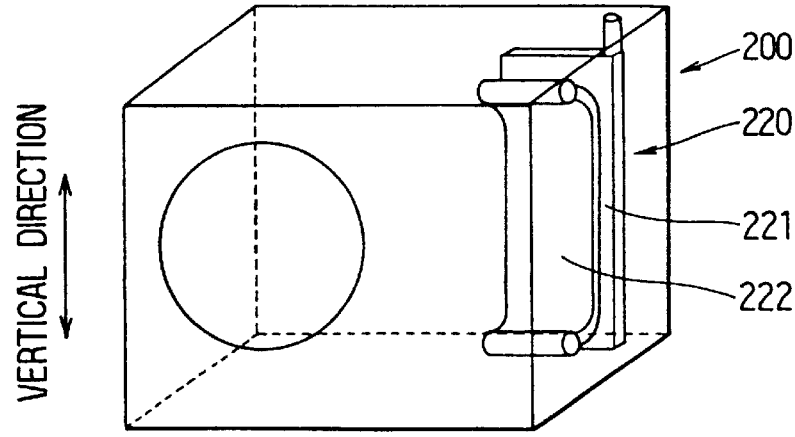

As opposed to this, in the fourth embodiment, the heat exchanger 220 is arranged as shown in FIGS. 9B or 9C to improve the heat exchanging efficiency. In FIG. 9B, the first tube 221 is positioned above the second tube 222 in the vertical direction, and in FIG. 9C, both the first and second tubes 221 and 222 are disposed vertically.

Accordingly, water flowing at the lower side in the passage of the first tube 221 with a lower temperature can effectively exchange heat with refrigerant flowing in the second tube 222 since the lower side of the first tube 221 contacts the second tube 222. As a result, the heat exchanging efficiency can be improved. When the heat exchanger 220 is disposed vertically as shown in FIG. 9C, since large part of the heat exchanger 220 can be separated from the bottom of the body of the hot-water supply system 200 as compared to the cases in which the heat exchanger 220 is disposed horizontally as shown in FIGS. 9A and 9B, the heat exchanger 220 is less susceptible to moisture from the ground, i.e., is difficult to be corroded.

The position and direction of the heat exchanger 220 with respect to the body of the hot-water supply system 200 is not limited to those shown in FIGS. 9B and 9C, but are changeable. For instance, the heat exchanger 220 may be inclined with respect to the vertical or horizontal direction. The structure of the heat exchanger 220 is substantially the same as that described in the other embodiments, but is not limited to those.

In the above embodiments, while the present invention is applied to the water heat exchanger for exchanging heat between refrigerant and water, the present invention can be applied to other heat exchangers such as a radiator for exchanging heat between water and air, a radiator or a gas cooler for exchanging heat between refrigerant and air, and the like.

Fifth Embodiment

Figure 10:
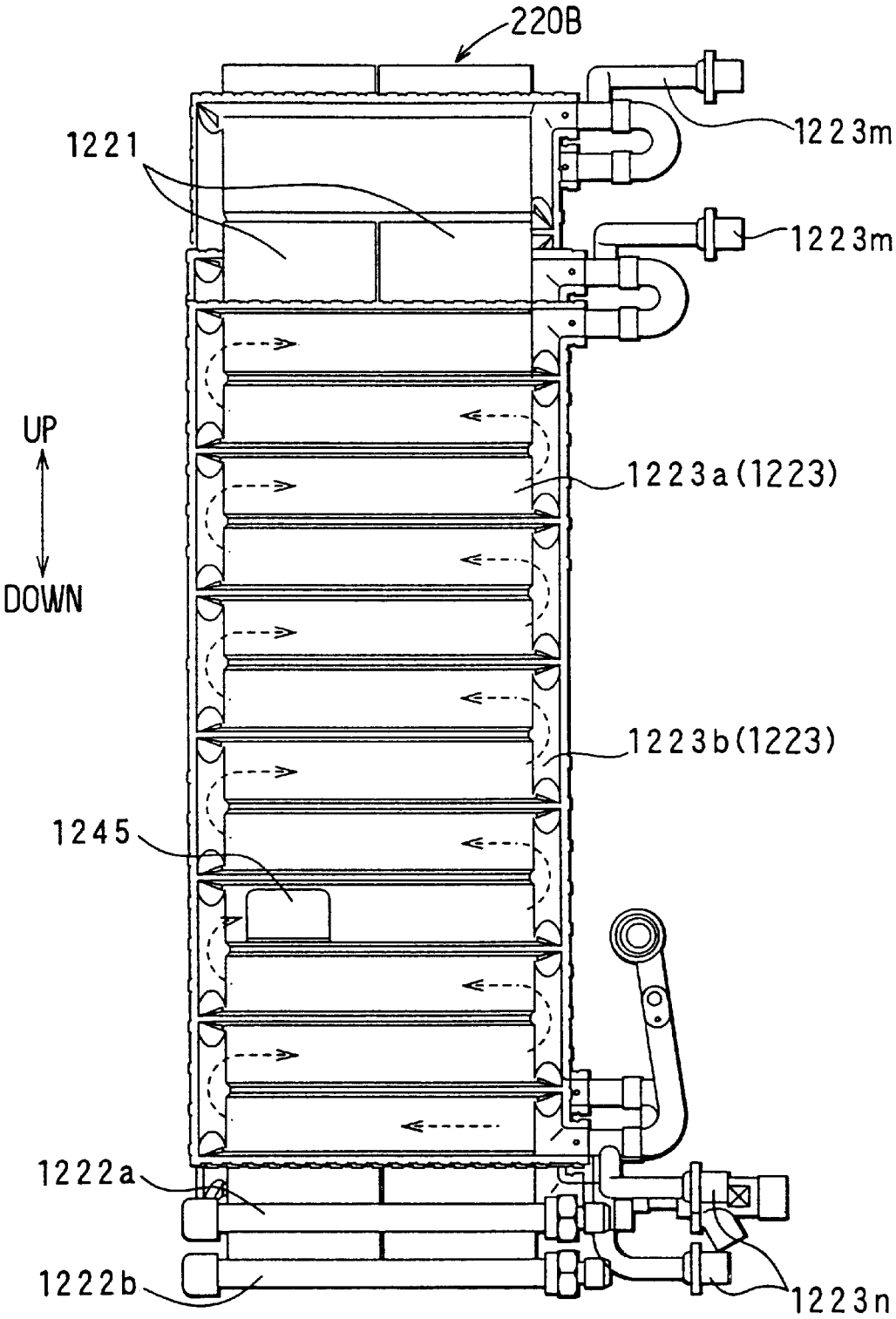
FIG. 10 is a front view showing a heat exchanger in a fifth preferred embodiment.
Figure 11:
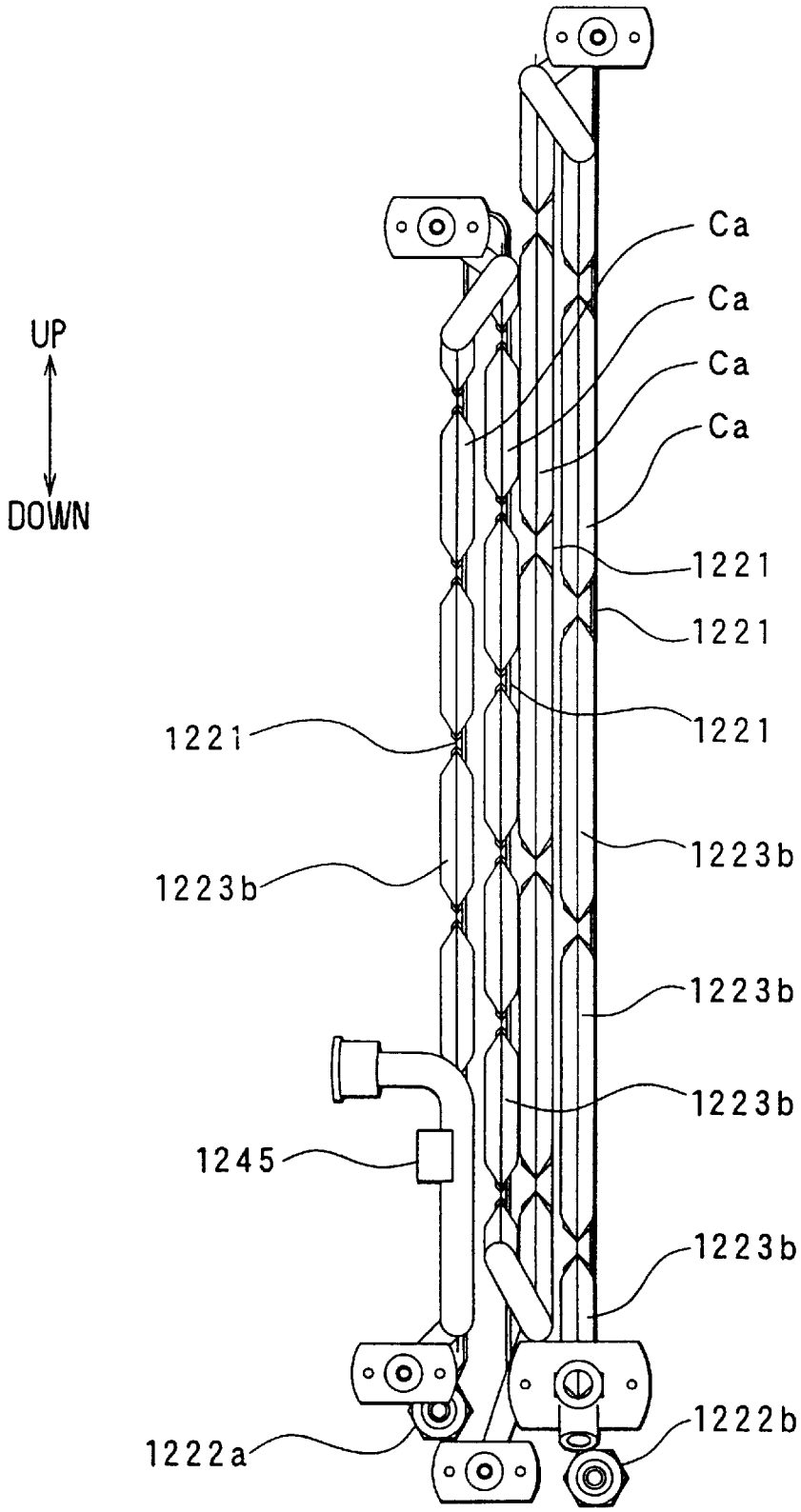
FIG. 11 is a right side view showing the heat exchanger shown in FIG. 10.

FIG. 10 is a front view showing a water heat exchanger 220B in a fifth preferred embodiment according to the present invention, and FIG. 11 is a side view of FIG. 10. Referring to FIGS. 10 and 11, the heat exchanger 220B has a flat refrigerant tube 1221 that extends in a left-right direction on the paper space while meandering with a serpentine shape as shown in FIG. 11. That is, the refrigerant flows in a part of the refrigerant tube 1221 upward in a vertical direction, changes its flowing direction, and flows in a next part of the refrigerant tube 1221 downward in the vertical direction. As a result, the refrigerant flows in a left direction in FIG. 11.

Figure 12:
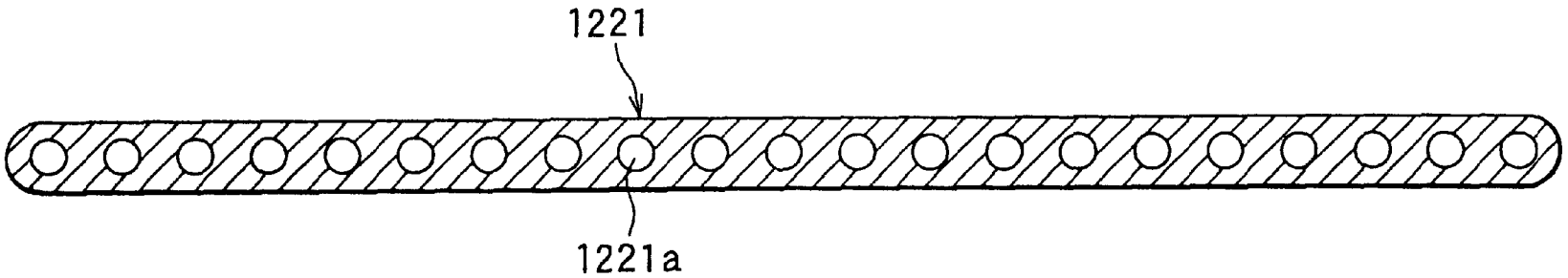
FIG. 12 is a cross-sectional view showing a refrigerant tube of the heat exchanger in the fifth embodiment.

The refrigerant tube 1221 is formed of aluminum by extrusion or drawing, and as shown in FIG. 12, has several refrigerant passages 1221*a* therein with a multi-hole structure. Accordingly, the refrigerant tube 1221 has an improved with stand pressure strength.

Referring back to FIG. 10, refrigerant tube headers 1222*a*, 1222*b* are provided at both ends of the refrigerant tube 1221 in the refrigerant flow direction and communicate with the respective refrigerant passages 1221*a*. The refrigerant tube header 1222*a* distributes refrigerant into the refrigerant passages 1221*a*, and the refrigerant tube header 1222*b* collects refrigerant discharged from the refrigerant passages 1221*a* after refrigerant exchanges heat with water.

A water tube 1223 in which water flows therein is composed of several water tube bodies 1223*a* each of which is provided with a longitudinal direction perpendicular to the longitudinal direction (refrigerant flow direction) of the refrigerant tube 1221 and contacts the refrigerant tube 1221, water tube headers 1223*b* provides at the ends in the longitudinal direction of the water tube bodies 1223*a* and connecting adjacent two of the water tube bodies 1223*a* for turning the flow direction of water at 180°, and the like. The water tube 1232 extends at an entire region in the longitudinal direction (vertical direction) of the refrigerant tube 1221.

On the other hand, as shown in FIG. 11, the refrigerant tube 1221 extends in the direction (right and left direction in the paper space) perpendicular to the longitudinal directions of the water tube headers 1223*b* and the water tube bodies 1223*a*, while meandering with a serpentine shape as shown in FIG. 11. That is, the refrigerant tube 1221 is bent three times in the longitudinal direction with the serpentine shape. On other words, the refrigerant tube 1221 is composed of several portions each of which extends in the longitudinal direction (vertical direction) of the water tube header 1223*b* to form the serpentine shape cooperatively.

Figure 13:
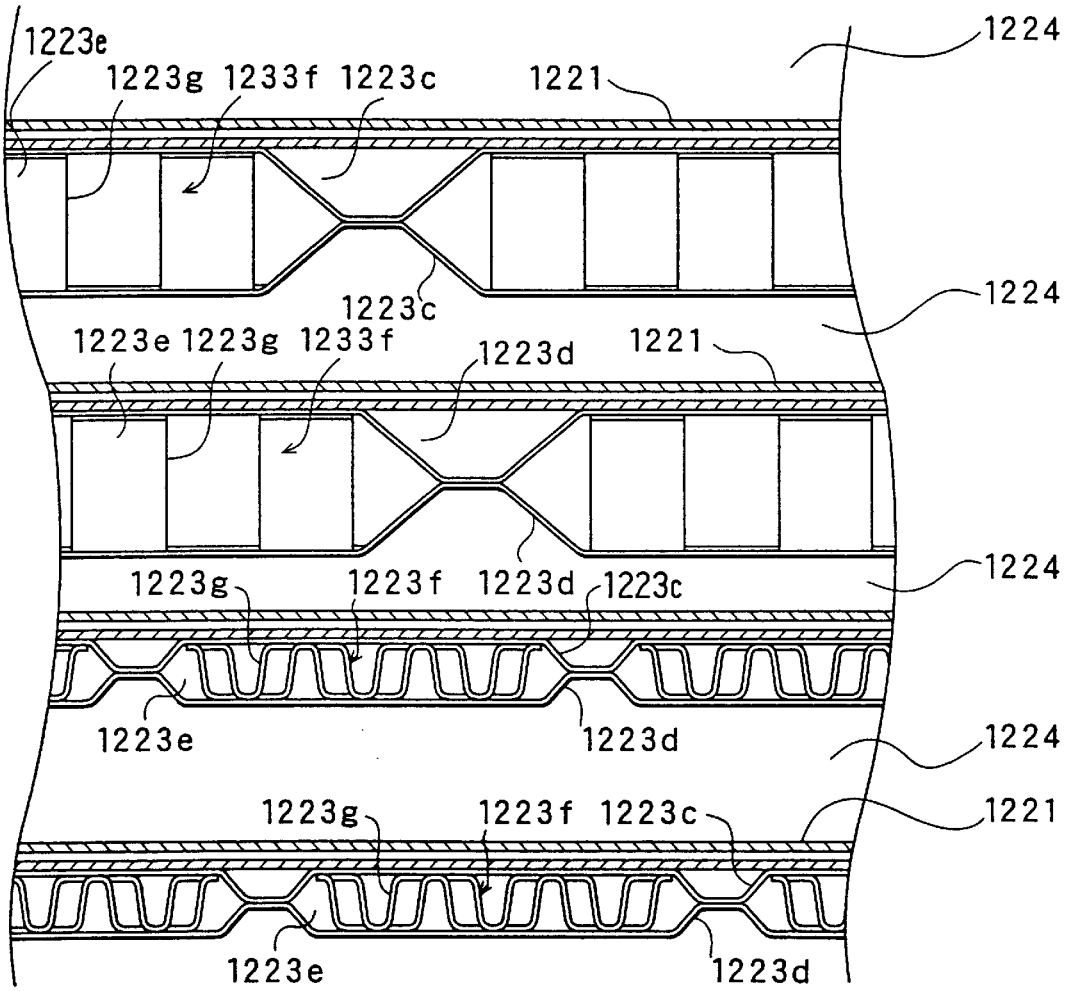
FIG. 13 is a cross-sectional view partially showing a tube part of the heat exchanger in the fifth embodiment.

Accordingly, as shown in FIG. 13, four heat exchanger cores Ca are provided to overlap with one another in the direction approximately perpendicular to the refrigerant tube 1221 and the water tube 1223. Each of the heat exchanger cores Ca is composed of the refrigerant tube 221 and the water tube 1223 contacting each other such that water is made serpentine while perpendicularly crossing the refrigerant flow. Adjacent two of the heat exchange cores Ca defines there between a space (gap) 1224. Because of this, the refrigerant tube 1221 is thermally insulated from its adjacent heat exchange core Ca by the space 1224 at a side opposite to the water tube 1223.

In each heat exchange core Ca, as shown in FIG. 10, water flows in the water tube 1223 while meandering to cross the refrigerant flow perpendicularly from an end to the other end in the longitudinal direction of the refrigerant tube 1221. Thus, the water flow is a perpendicularly crossing flow with respect to the refrigerant flow.

As shown in FIG. 13, the water tube 1223 (water tube bodies 1223*a*) is composed of first and second plates 1223*c*, 1223*d* that are formed by pressing to have bathtub (arched) parts and are brazed to each other. An offset type inner fin 1223*f* is disposed inside the water tube 1223 (water passage 1223*e*). The first and second plates 1223*c*, 1223*d*, and the inner fin 1223*f* are made of metal such as copper having high corrosion resistance.

The offset type fin (multi-entry type fin) 1223*f* is composed of several plate like segments 1223*g* offset-disposed with a stagger arrangement, which is disclosed in Heat Exchanger Design Handbook (published by KOUGAKU-TOSHO Co., Ltd.), 19th Japan Heat Transfer Symposium Paper, and the like. The inner fin 1223*f* has different specifications (pitch of the segments, directions of the segments, and the like) at the water inlet side and the water outlet side of the water tube 1223 (in the present embodiment, between the two heat exchange cores Ca provided at the water inlet side and the two exchange cores Ca provided at the water outlet side).

Figure 14:
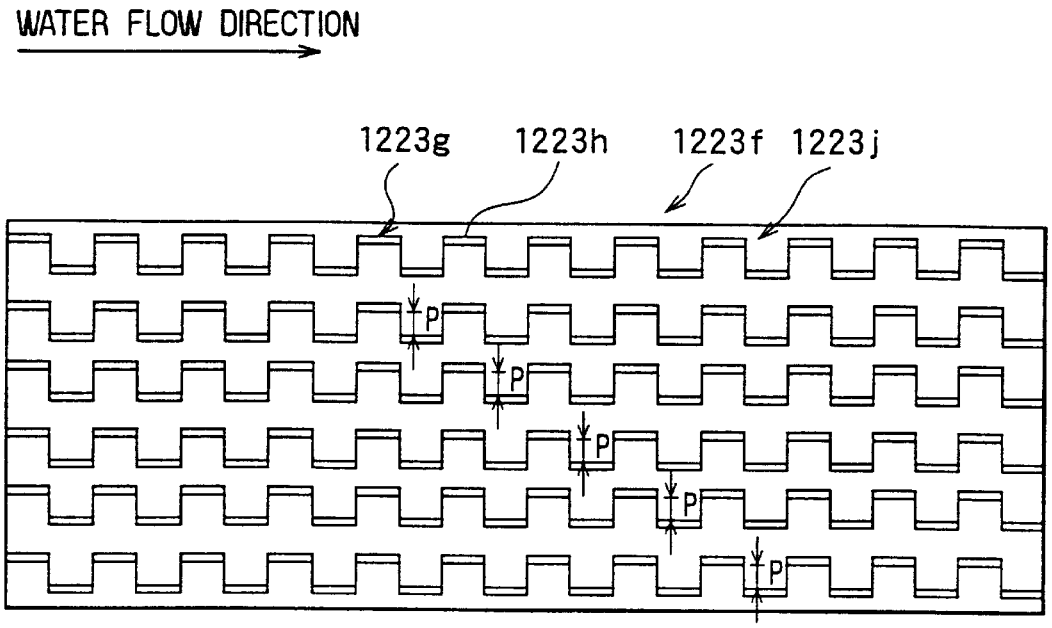
FIG. 14 is a schematic view showing a parallel segment portion of an inner fin in the fifth embodiment.

Specifically, at the water inlet side of the water tube 1223 (in the two heat exchange cores Ca provided at the water inlet side), as shown in FIG. 14, each segment 1223*g* is disposed with a plate surface 1223*h* approximately parallel to the water flow direction. On the other hand, at the water outlet side of the water tube 1223 (in the two heat exchange cores Ca provided at the water outlet side), as shown in FIG. 15, each segment 1223*g* is disposed with a plate surface 1223*h* approximately perpendicular to the water flow direction.

Hereinafter, the part in which the plate surfaces 1223*h* of the segments 1223*g* are approximately parallel to the water flow direction is referred to as a parallel segment portion 1223*j*, and the part in which the plate surfaces 1223*h* of the segments 1223*g* are approximately perpendicular to the water flow direction is referred to as a perpendicular segment portion 1223*k*.

Figure 15:
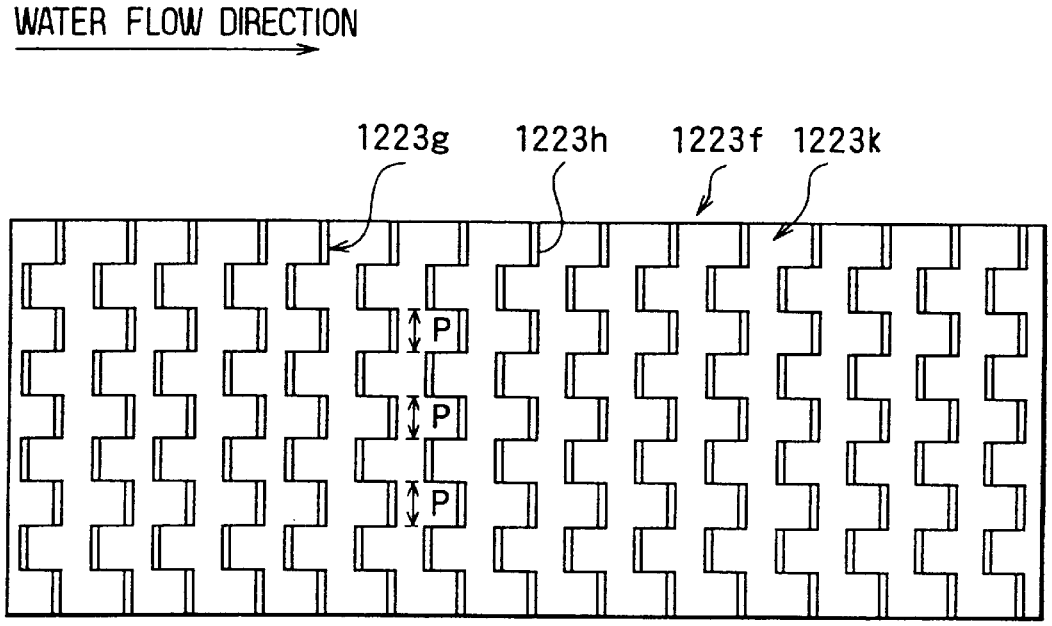
FIG. 15 is a schematic view showing a perpendicular segment portion of an inner fin in the fifth embodiment.

In the present embodiment, referring to FIGS. 14 and 15, a pitch p of the segments 1223*g* in a direction approximately perpendicular to the water flow direction is different between the parallel segment portion 1223*j* and the perpendicular segment portion 1223*k*. Specifically, as shown in FIG. 13, the pitch P at the perpendicular segment portion 1223*k* (at the outlet side of the water tube 1223) is larger than the pitch P at the parallel segment portion 1223*j* (at the inlet side of the water tuber 1223).

Incidentally, as shown in FIGS. 10 and 11, an air vent pipe 1223*m* is provided at the upper side of the water heat exchanger 220B to release air from the water tube 1223, and a water vent pipe 1223*n* is provided at the lower side to release water from the water tube 1223. A bracket 1245 is joined to the water tuber 1223 (at least one of the water tube bodies 1223*a*) by brazing, for fixing the water heat exchanger 220B.

Next, a method for manufacturing the water heat exchanger 220B according to the present embodiment is explained. First, the first and second plates 1223*c*, 1223*d* formed into a specific shape (bathtub shape) and the inner fin 1223*f* are prepared. At a brazing filler metal coating step, flux and brazing filler metal (alloy of phosphorus and copper) are coated to contact surfaces of the plates 1223*c*, 1223*d* that are to contact each other, and contact surfaces of the inner fin 1223*f* that are to contact the plates 1223*c*, 1223*d*. Then, at a first temporarily assembling step, the plates 1223*c*, 1223*d*, and the inner fin 1223*f* are assembled as shown in FIG. 13, and its assembled state is kept by a jig such as a wire.

Figure 16:
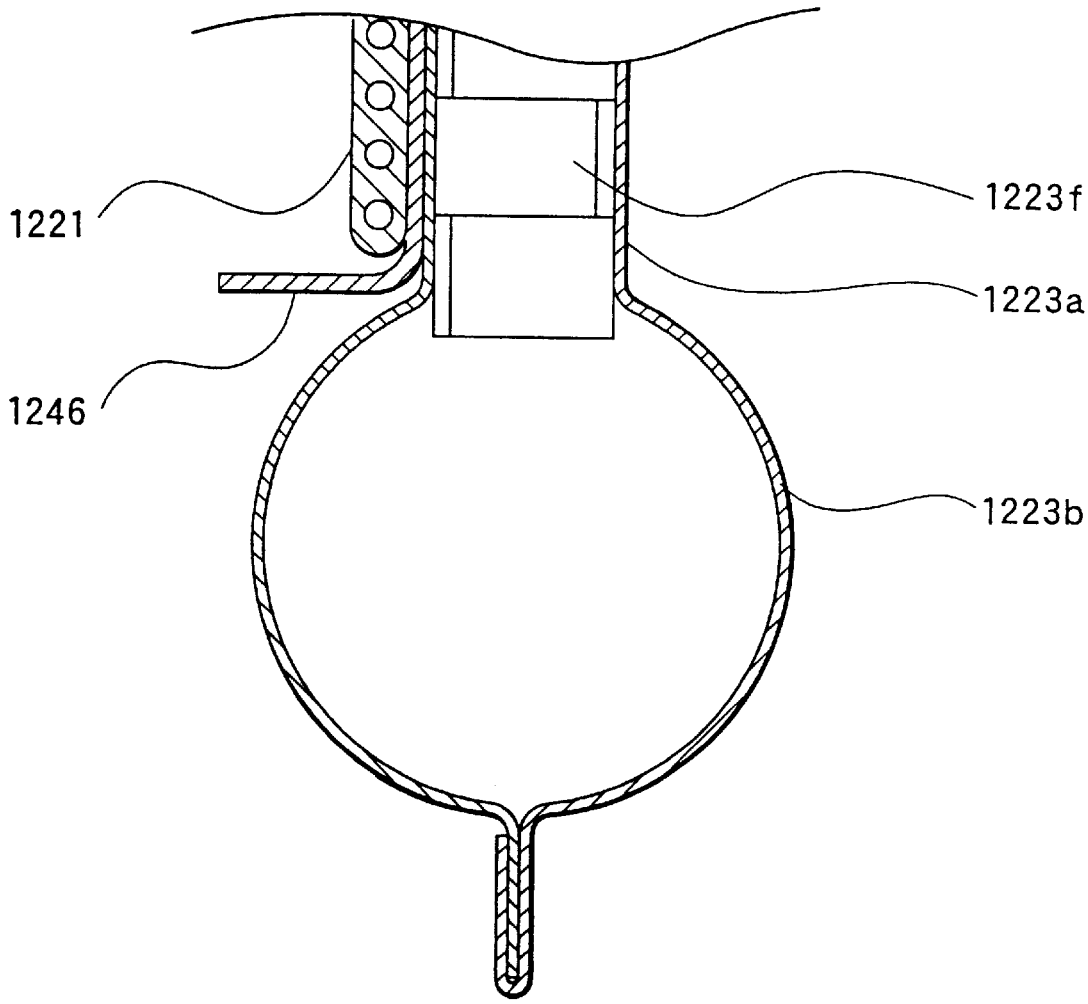
FIG. 16 is an enlarged cross-sectional view showing a water tube header of the heat exchanger and its vicinity in the fifth embodiment.

Next, as shown in FIG. 16, a joint plate (separation plate for brazing) 1246 clad with a brazing filler metal (aluminum material having a melting point lower than that of the refrigerant tube 1221 in this embodiment) is interposed between the tube 1223 formed at the first temporarily assembling step and the refrigerant tube 1221. In this state, the tubes 1221, 1223 are fixed to each other by a jig such as a wire as shown in FIG. 13. This is a second temporarily assembling step.

The joint plate 1246 contains iron system metal as a main component and is coated (plated) with aluminum on both surfaces thereof. On the aluminum coating layer (plating layer), a brazing filler metal is applied or inserted. An end portion of the joint plate 1246 is, as shown in FIG. 16, bent with an L shape, which securely prevents the aluminum-made refrigerant tube 1221 and the copper-made water tube 223 (the water tube bodies 1223*a* and the water tube headers 1223*b* from contacting one another during its brazing. At a brazing step, the member assembled at the second temporarily assembling step is heated within a furnace, so that the tubes 1221, 1223 are joined to each other by brazing.

Next, the features of the present embodiment are explained. According to the present embodiment, since the water flow and the refrigerant flow cross each other perpendicularly, heat exchange can be effectively performed between water and refrigerant. Also, each of the refrigerant tube 1221 and the water tube 1223 meanders or serpentines, the heat exchange area between water and refrigerant is increased without increasing the size of the water heat exchanger 220B. Therefore, according to the present embodiment, the heat exchanging efficiency can be improved while achieving size reduction of the water heat exchanger 220B.

Incidentally, since calcium (Ca) is contained in water (especially, in service water), calcium dissolved in water is deposited due to a decrease in solubility of calcium when a temperature of water is raised by heating. The deposited calcium may cause clogging of the water tube to disturb the operation of the heat exchanger.

If the cross-sectional passage area of the water tube is increased by estimating an amount of deposited calcium, a flow velocity of water flowing in the water tube is reduced and the flowing state of water becomes a laminar flow. As a result, the thermal conductivity between water and the water tube is decreased, thereby lessening the heat exchanging efficiency.

As opposed to this, according to the present invention, since the inner fin 1223*f* is disposed within the water tube 1223, the heat transfer area between water and the water tube 1223 is increased, and the flow state of water flowing in the water tube 1223 becomes a turbulent flow by being disturbed by the inner fin 1223*f*. As a result, the thermal conductivity between water and the water tube 1223 is increased. Therefore, the cross-sectional passage area of the water tube 1223 can be set larger by estimating the amount of deposited calcium. This is because the heat exchanging efficiency is not decreased even when the cross-sectional passage area is increased. Accordingly, the heat exchanging efficiency can be improved while preventing the clogging of the water tube 1223 by calcium.

Incidentally, assuming that the water tube 1223 is linear and water flows straightly in a direction opposite to the refrigerant as an opposed flow, the width of the water tube 1223 and the width of the refrigerant tube 1221 must be made equal to each other to secure the heat transfer area (contact area) between the water tube 1223 and the refrigerant tube 1221. Here, the width of the tube is a dimension of the tube parallel to a direction perpendicular to the longitudinal direction of the tube.

When the width of the water tube is equal to that of the refrigerant tube, however, the width of the water tube 1223 (water passage) is so large that it is difficult for water to flow in the entire region in the width direction of the water tube (water passage) uniformly. A part of the water tube where a water flow amount is small would have small heat exchanging capability, resulting in lessened heat exchanging capability of the water heat exchanger.

As opposed to this, according to the present embodiment, as shown in FIG. 10, the heat exchanger 220B is constructed as a perpendicularly crossing type such that the water tube 1223 is disposed perpendicularly to the refrigerant tube 1221 at the entire region in the longitudinal direction of the refrigerant tube 1221. Accordingly , the width of the water tube 1223 can be reduced while securing the heat transfer area (contact area) between the water tube 1223 and the refrigerant tube 1221. This makes it possible that water flows uniformly at the entire region in the width direction of the water tube 1223 (water passage 1223*e*), and improves the heat exchanging capability of the heat exchanger 220B.

Here, although the cross-sectional passage area of the water tube 1223 is increased by estimating an amount of calcium to be deposited, since the inner fin 1223*f* is disposed inside the water tube 1223 (water tube bodies 1223*a*), a substantial cross-sectional passage area may be reduced due to the existence of the inner fin 1223*f*.

Therefore, according to the present embodiment, the pitch P at the water outlet side (perpendicular segment portion 1223*k*) where calcium is liable to be deposited due to a high temperature of water is set to be larger than the pitch P at the water inlet side (parallel segment portion 1223*j*) where calcium is less liable to be deposited due to a low temperature of water. Accordingly, the clogging of the water tube 1223 can be prevented while the cross-sectional passage area is prevented from being reduced substantially. Incidentally, in the present embodiment, the pitch P at the perpendicular segment portion 1223*k* is 10 mm, and the pitch P at the parallel segment portion 1223*j* is 4 mm.

Further, when the pitch P is increased, the water flow may approach a laminar flow region and the heat transfer coefficient a between the inner fin 1223*f* and water may be reduced to decrease the heat exchanging efficiency.

To prevent this problem, according to the present embodiment, at the water outlet side of the water tube 1223 where the pitch P of the inner fin 1223*f* is large, the plate surfaces 1223*h* of the segments 1223*g* are arranged to be approximately perpendicular to the water flow. Therefore, the water flow hits the plate surfaces 1223*h* of the segments 1223*g* to be disturbed, and the heat transfer coefficient a is prevented from being decreased.

Figure 17:
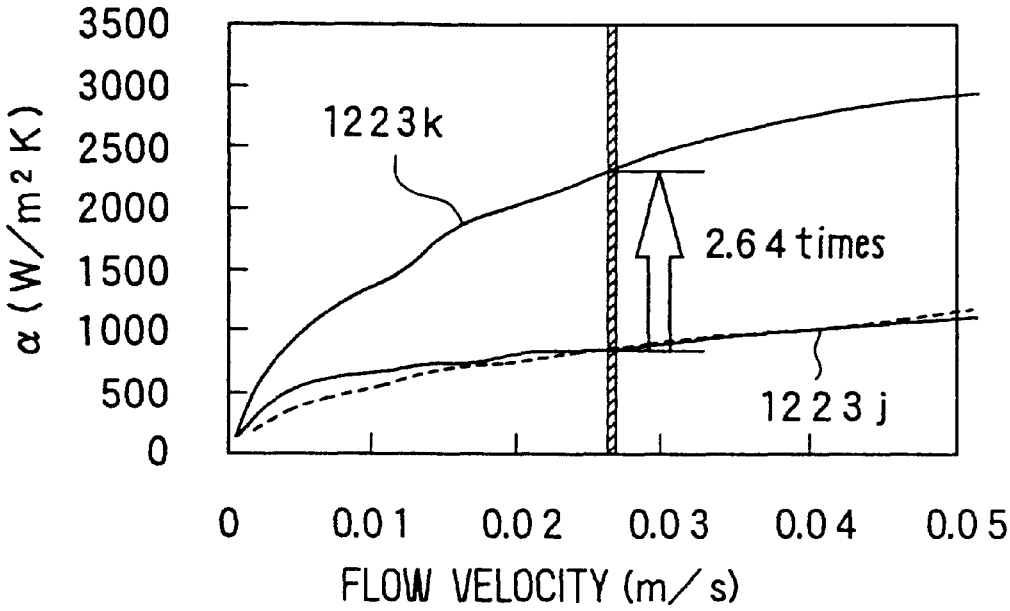
FIG. 17 is a graph showing a relation between a flow velocity of water and heat transfer coefficient.

FIG. 17 shows an experimental result indicating the heat transfer coefficient α at the perpendicular segment portion 1223*k* and the heat transfer coefficient α at the parallel segment portion 1223*j*. Accordingly, it is revealed that the heat transfer coefficient a at the perpendicular segment portion 1223*k* is larger than that at the parallel segment portion 1223*j*.

Figure 18:
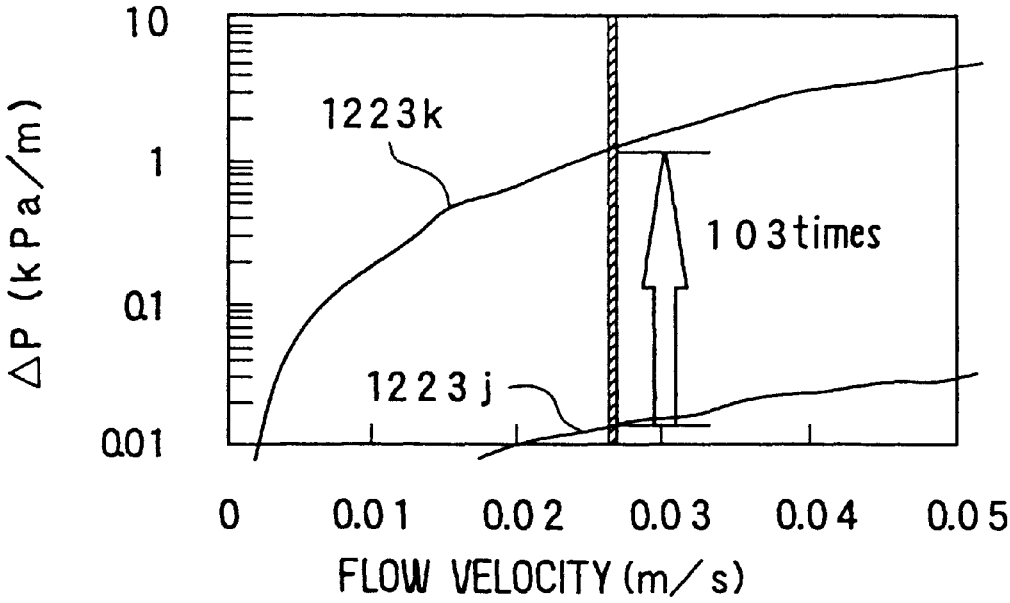
FIG. 18 is a graph showing a relation between a flow velocity of water and pressure loss.

Incidentally, at the perpendicular segment portion 1223*k*, since the plate surfaces 1223*h* of the segments 1223*g* are approximately perpendicular to the water flow, as shown in FIG. 18, pressure loss ΔP produced when water passes through the perpendicular segment portion 1223*k* is large. However, since the flow velocity of water at the perpendicular segment portion 1223*k* is decreased as compared to that at the water inlet side of the water tube 1223, the actual pressure loss ΔP at the perpendicular segment portion 1223*k* is decreased. Therefore, the perpendicular segment portion 1223*k* provided at the water outlet side of the water tube 1223 causes no problems on a practical usage.

Mean while, the material forming the refrigerant tube 1221 (aluminum in the present embodiment) has a melting point largely different from that of the material forming the water tube 1223 (copper in the present embodiment). Because of this, a low melting point compound of aluminum and copper may be produced when the tubes 1221, 1223 are brazed to each other in a state where they directly contact each other. The low melting point compound can cause brazing deficiencies.

As opposed to this, according to the present embodiment, the tubes 1221, 1223 are brazed to each other with the joint plate 1246 interposed therebetween. The tubes 1221, 1223 do not contact directly during the brazing. Therefore, the low melting point compound is not produced, and no brazing deficiencies occur. Only one brazing step is sufficient to braze the tubes 1221, 1223 in the present embodiment. As opposed to this, if the tubes 1221, 1223 are brazed without the joint plate 1246 interposed therebetween, the brazing step should be performed twice or more. For instance, the tubes 1221, 1223 are brazed after the water tube 1223 is brazed completely.

Also, according to the present embodiment, the space 1224 is defined between adjacent two heat exchange cores Ca, and the refrigerant tube 1221 is thermally insulated from its adjacent heat exchange core Ca by the space 1224 at an opposite side of the contacting water tube 1223. The space 1224 prevents the heat exchange between the adjacent two heat exchange cores Ca. Accordingly, the water heat exchanger 220B approaches an ideal perpendicularly crossing type heat exchanger ("Compact Heat Exchanger" published by Nikkan-Kogyo newspaper publishing company) with improved heat exchanging efficiency. It is apparent that the present embodiment can be combined with the other embodiments appropriately.

Sixth Embodiment

Figure 19:
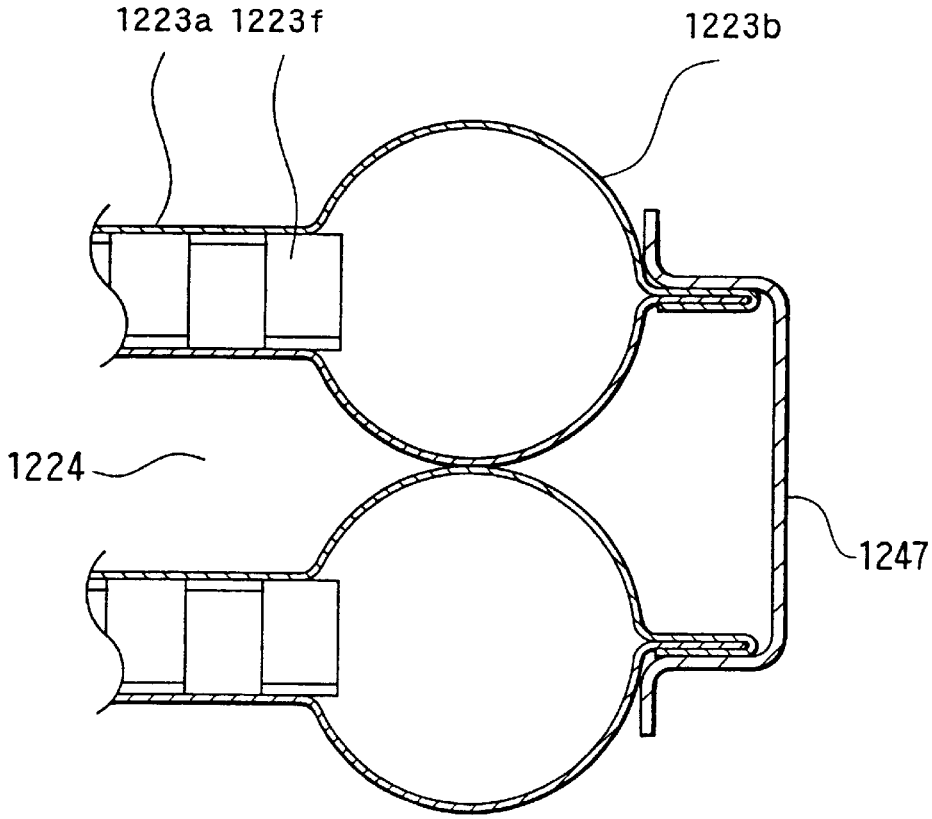
FIG. 19 is an enlarged cross-sectional view showing water tube headers and a support bracket of a heat exchanger according to a sixth preferred embodiment.
Figure 20:
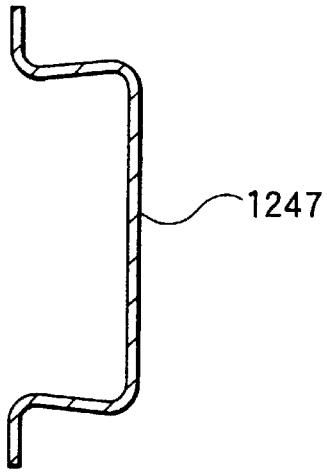
FIG. 20 is a cross-sectional view showing the support bracket of the heat exchanger in the sixth embodiment.

In a sixth preferred embodiment, as shown in FIG. 19, a support bracket 1247 is provided to securely fix the space (distance) between two heat exchange cores Ca (two water tubes 1223) adjacent to each other. Referring to FIG. 20, the support bracket 1247 is a clip made of a spring steel product having a generally U shape, and fixed to the water tube headers 1223*b* of the adjacent two heat exchange cores Ca by being expanded at the opening portion thereof. In FIG. 19, while the water tube headers 1223*b* of the two heat exchange cores Ca contact each other, heat transfer occurring between water flowing in one of the headers 1223*b* and water flowing in the other one of the headers 1223*b* does not affect the quantity of heat transfer between refrigerant and water. Therefore, the heat exchanging efficiency does not vary substantially. The other features are substantially the same as those in the fifth embodiment.

Seventh Embodiment

The melting point of the material (for instance, aluminum) forming the refrigerant tube 1221 is largely different from that of the material (for instance, copper) forming the water tube 1223. Therefore, the tubes 1221, 1223 may be deformed as bimetal due to a large difference in linear expansion coefficient thereof by brazing (heating).

Figure 21:
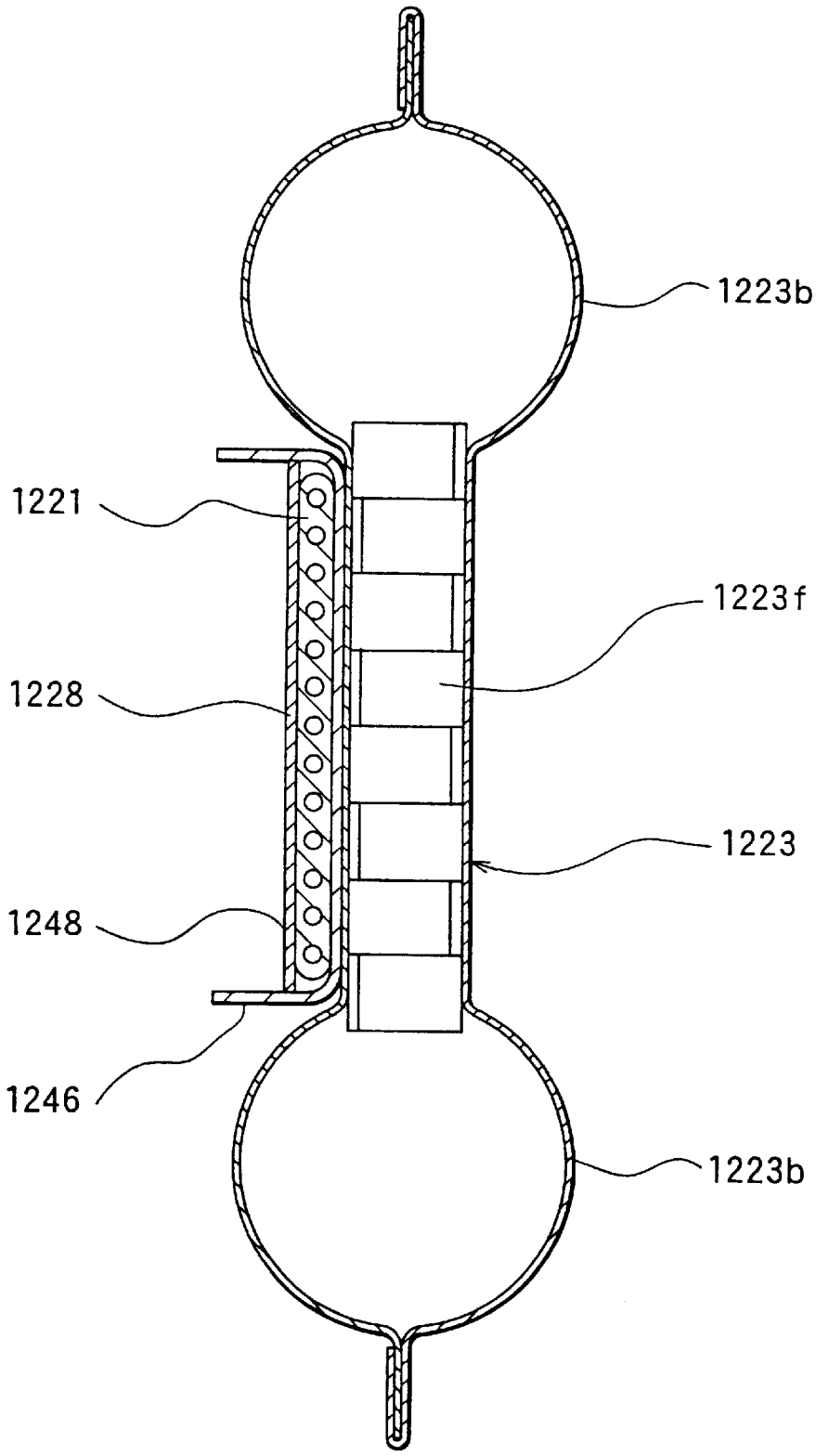
FIG. 21 is a cross-sectional view showing a tube part and a reinforcement plate of a heat exchanger according to a seventh preferred embodiment.

In this connection, in a seventh preferred embodiment, as shown in FIG. 21, a reinforcement plate 1248 is provided to increase flexural rigidity E1 of one (refrigerant tube 1221 in the present embodiment) of the tubes having larger linear expansion coefficient and smaller flexural rigidity than those of the other one (water tube 1223 in the present embodiment) of the tubes, at a side (side of the space 1224) opposite to the portion contacting the other tube (the water tube 1223), i.e., opposite to the joint plate 1246. Accordingly, the tubes 1221, 1223 can be prevented from being deformed by brazing (heating). The other features are substantially the same as those in the fifth embodiment.

Eighth Embodiment

Figure 22:
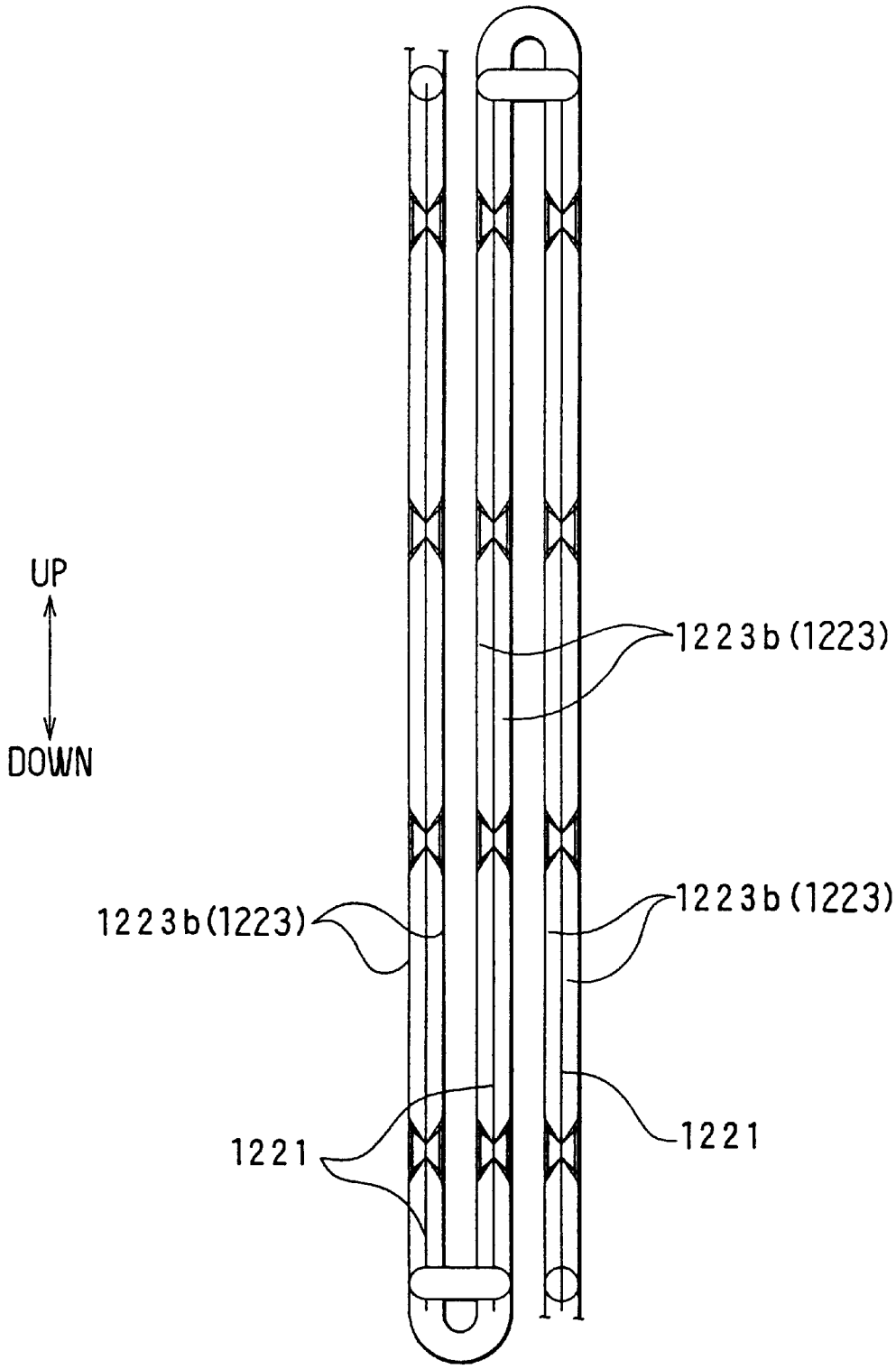
FIG. 22 is a side view showing a heat exchanger according to an eighth preferred embodiment.

In the fifth to seventh embodiments, the space 1224 is provided between two heat exchange cores Ca adjacent to each other, and the refrigerant tube 1221 is exposed to the space 1224 at the side opposite to the contacting water tube 1223. In an eighth preferred embodiment, as shown in FIG. 22, the refrigerant tube 1221 contacts the water tube 1223 at both flat surfaces thereof. Accordingly, the contact area between the refrigerant tube 1221 and the water tube 1223 is increased, thereby increasing the heat exchanging amount between water and refrigerant. While the refrigerant tube 1221 is made to contact the water tube 1223 at the both flat surfaces thereof, the water tube 1223 may contact the refrigerant tube 1221 at both flat surfaces thereof. The other features are substantially the same as those in the fifth embodiment.

The heat exchanger described in the fifth to eighth embodiment can be modified as follows.

Figure 23:
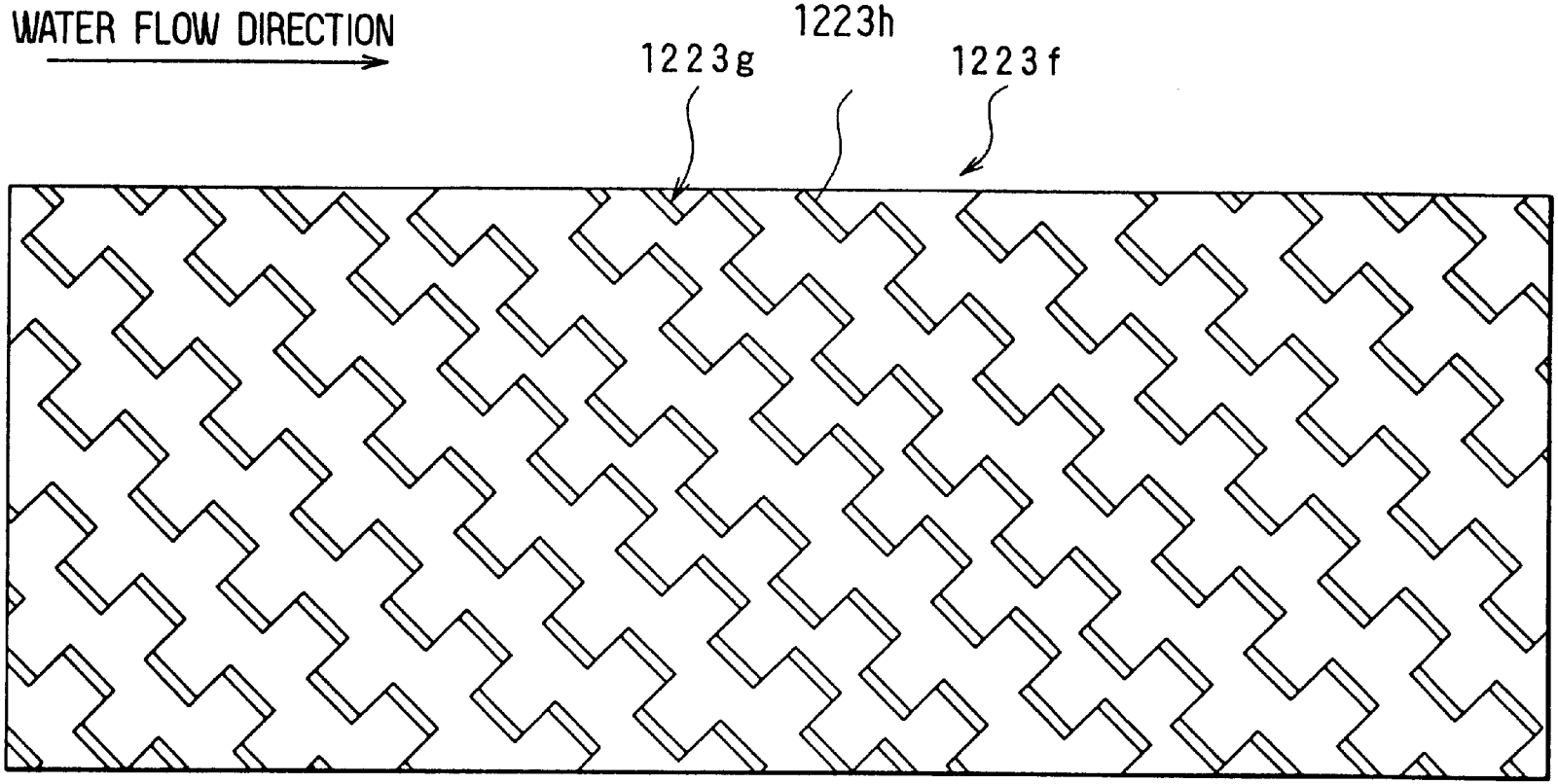
FIG. 23 is a schematic view showing segments of an inner fin in a first modified embodiment.

For instance, in the above embodiments, the plate surfaces 1223*h* of the segments 1223*g* are provided perpendicularly to the water flow at the water outlet side of the water tube 1223. However as shown in FIG. 23, the plate surfaces 1223*h* may be provided to cross the water flow with an acute angle.

Figure 24:
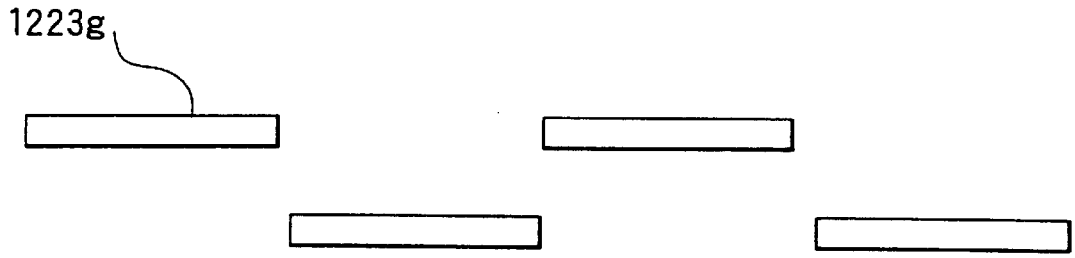
FIG. 24 is a schematic view showing segments of an offset fin.
Figure 25:
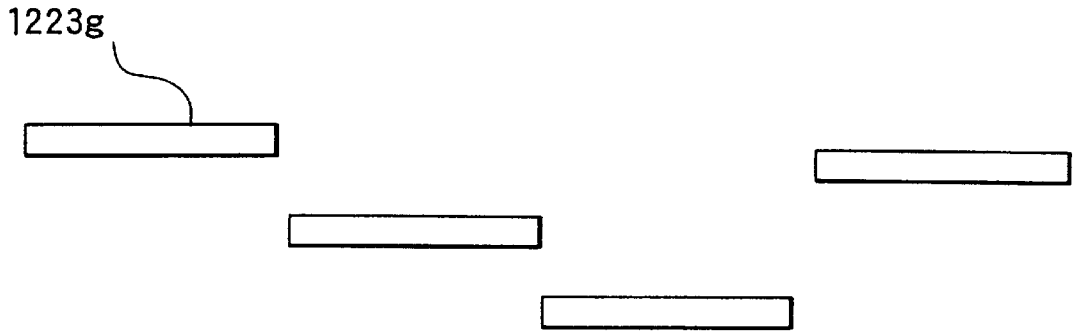
FIG. 25 is a schematic view showing segments of an offset fin in a second modified embodiment.
Figure 26:
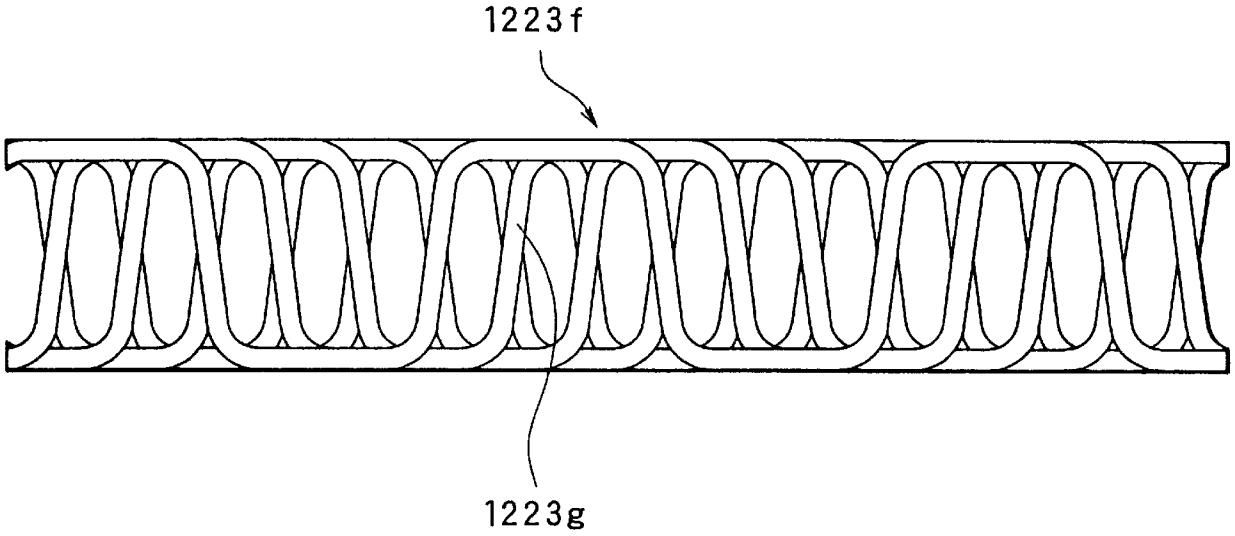
FIG. 26 is a schematic view showing an inner fin observed from an upstream side of water flow in the second modified embodiment.
Figure 27:
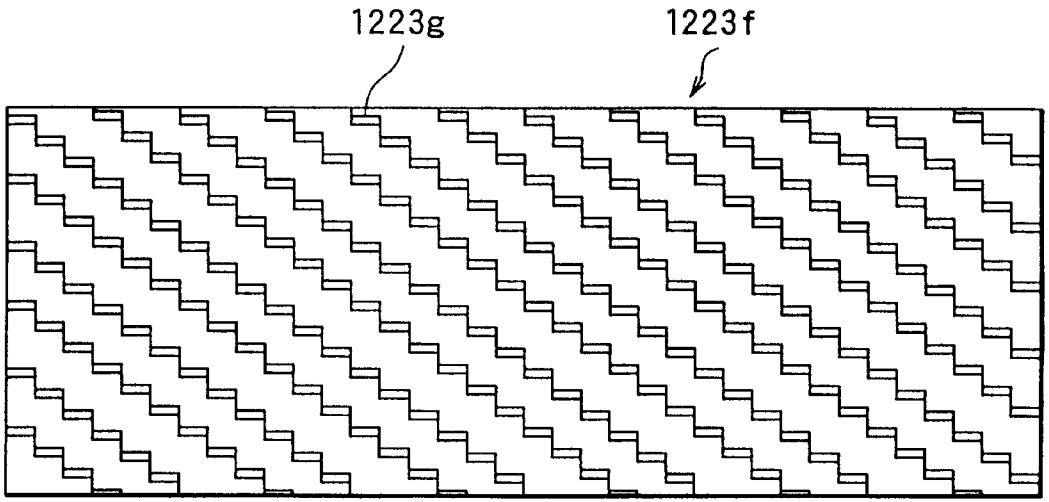
FIG. 27 is an upside view showing the inner fin in the second modified embodiment.

In the above embodiments, as shown in FIG. 24, the segments 1223*g* are provided with a stagger arrangement in which two segments 1223*g* constitute one pair. However, as shown in FIG. 25, the segments 1223*g* may be arranged with a stagger arrangement in which tree segments 1223*g* constitute one pair. FIG. 26 is a front view showing the inner fin 1223*f* having such modified arrangement, observed from the upstream side of the water flow, and FIG. 27 is an upper view showing the inner fin 1223*f* having the modified arrangement.

Figure 28:
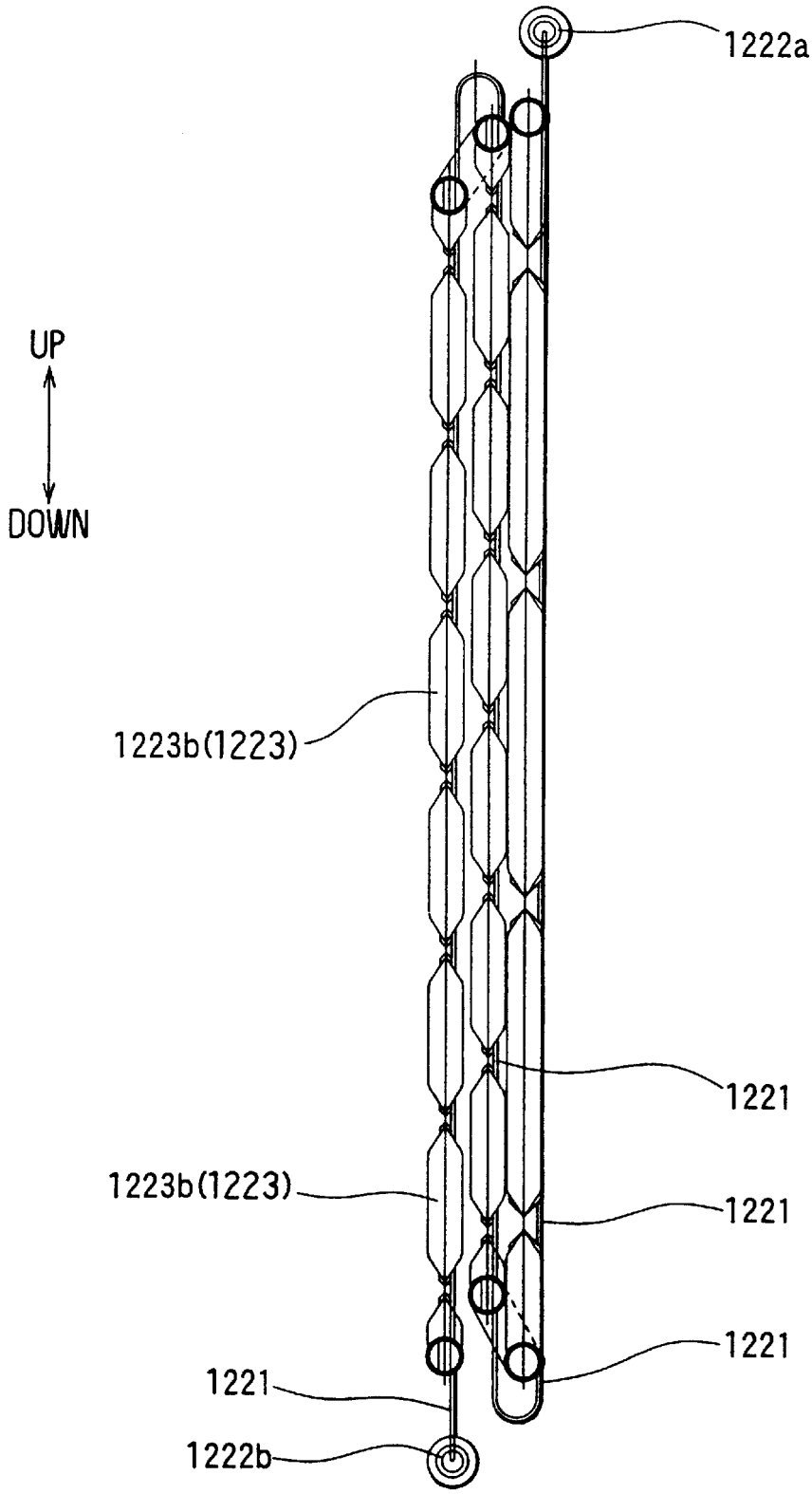
FIG. 28 is a side view showing a heat exchanger in a third modified embodiment.
Figure 29:
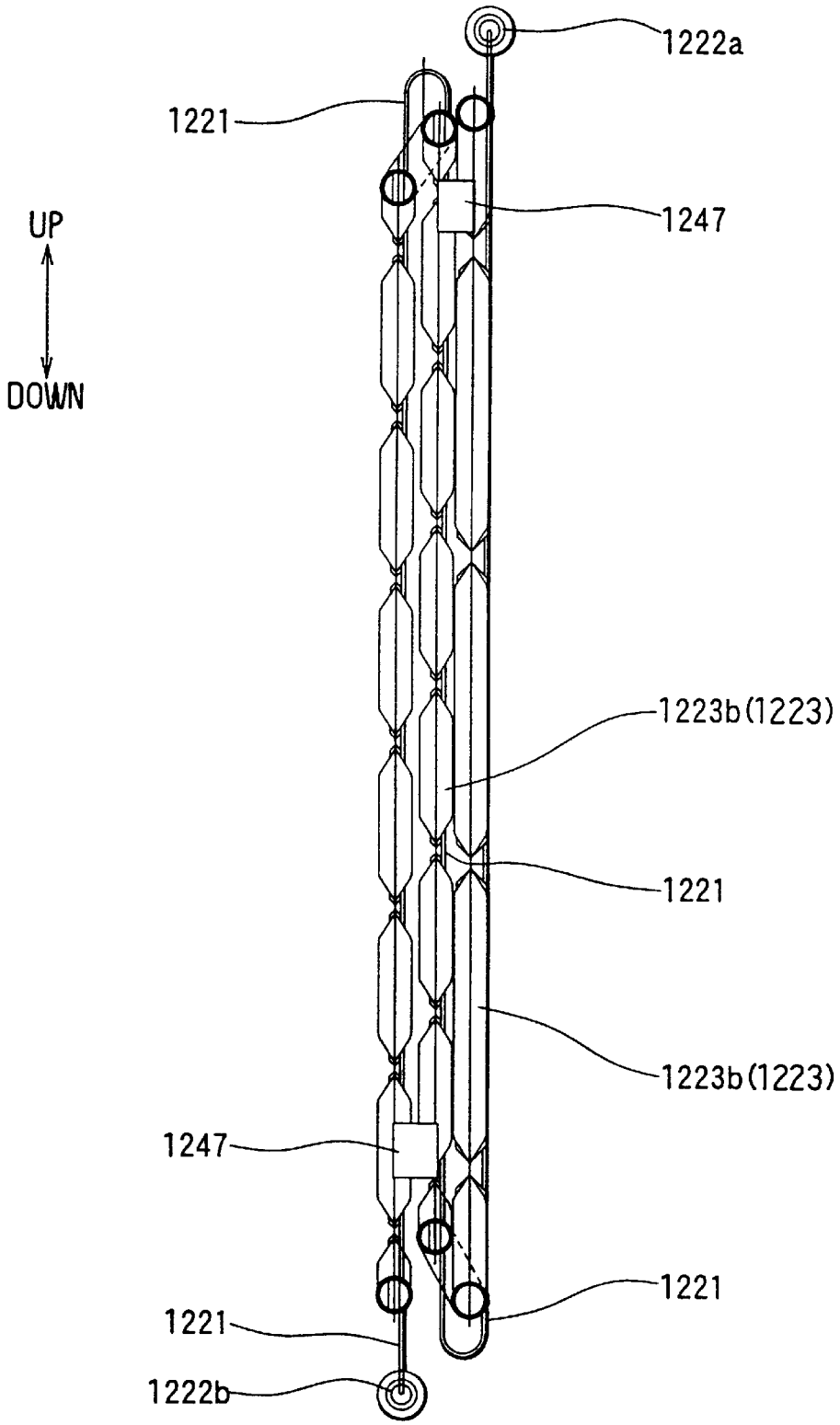
FIG. 29 is a side view showing the heat exchanger in the third modified embodiment.

Further, as shown in FIGS. 28 and 29, the heat exchanger may be constructed without the air vent pipe 1223*m* and the water bent pipe 1223*n*.

Figure 30:
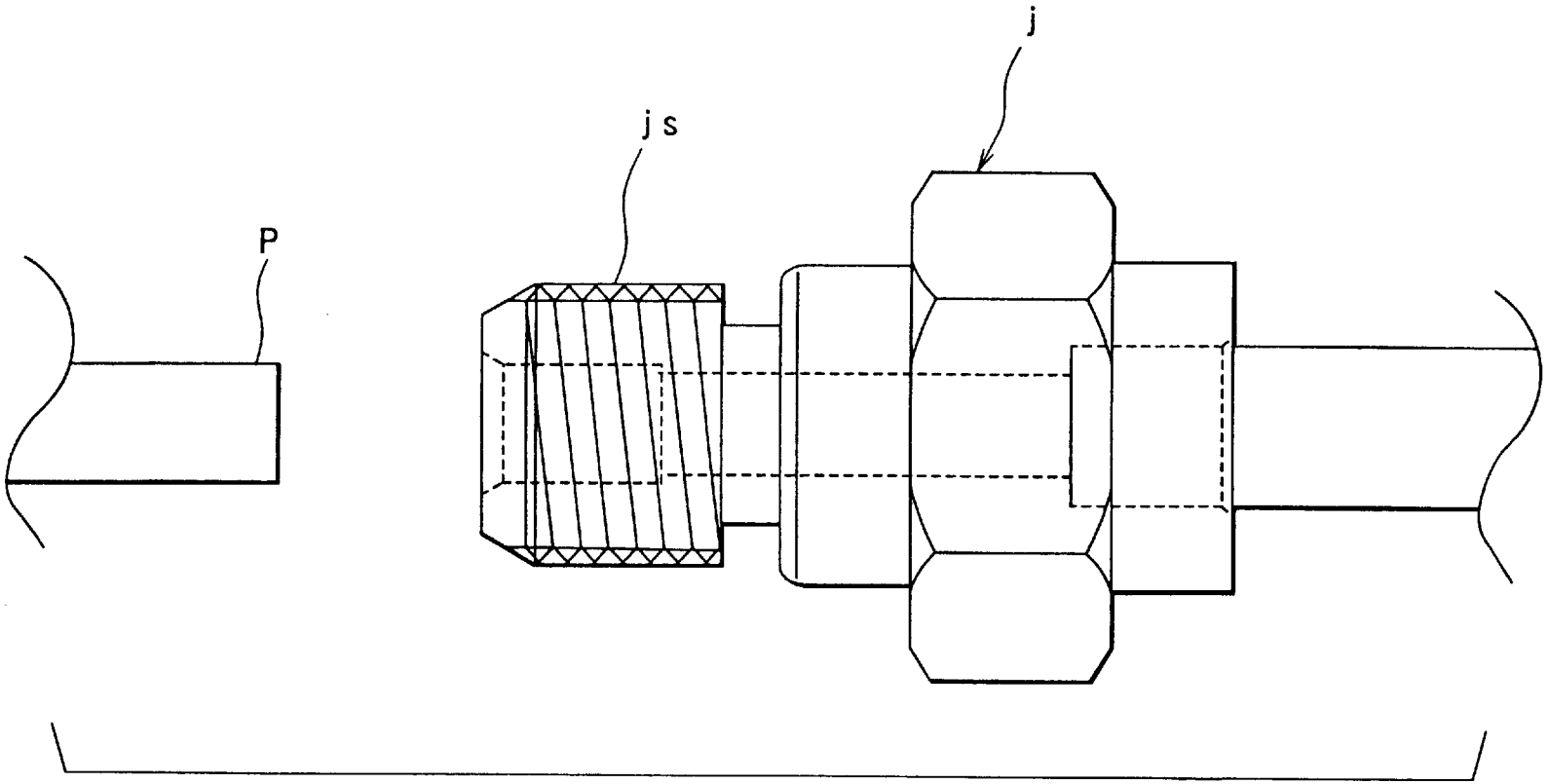
FIG. 30 is an enlarged view showing a joint portion of a heat exchanger in a fourth modified embodiment.
Figure 31:
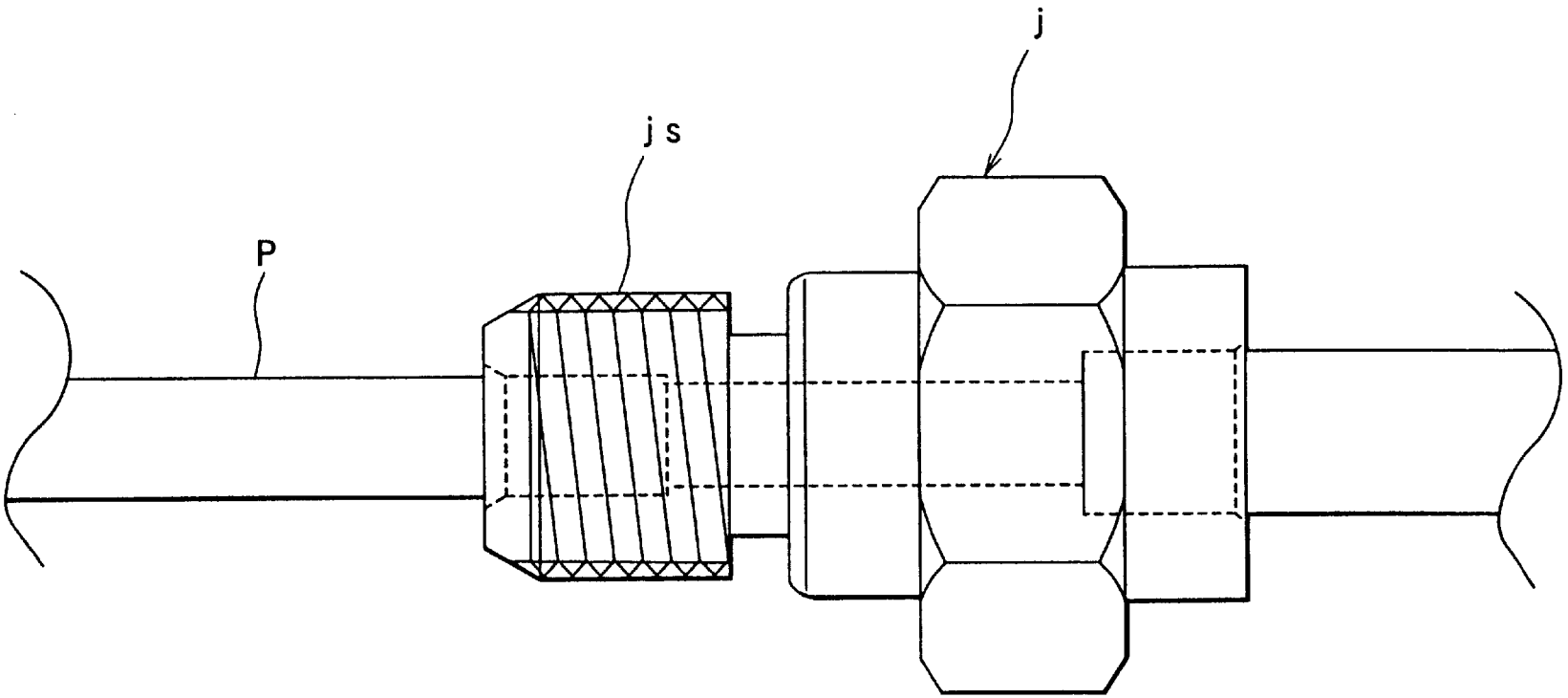
FIG. 31 is an enlarged view showing the joint portion of the heat exchanger in the fourth modified embodiment.

As shown in FIG. 30, a screw part js may be provided at a connection part j between the refrigerant tube 1221, the water tube 1223 and a pipe P so that a jig (not shown) for a withstand pressure test can be connected thereto. In this case, after the withstand pressure test is finished, as shown in FIG. 31, the pipe P is inserted into the connection part J and joined thereto by brazing or the like.

In the above embodiments, the specification of the inner fin 1223*f* at the inlet side of the water tube 1223 differs from that at the outlet side of the water tube 1223. However, the specification of the inner fins 1223*f* may be identical at the entire region from the inlet side to the outlet side in the water tube 1223.

Although the inclination of the plate surfaces 1223*h* of the segments 1223*g* of the inner fin 1223*f* is changed between the inlet side and the outlet side in the water tube 1223, the inclination of the plate surfaces 1223*h* may be the same at the entire region from the inlet side to the outlet side in the water tube 1223. In this case, only the pitch P may be changed between the inlet side and the outlet side. Even in this case, the inner fin 1223*f* can have various structures such as shown in FIGS. 14, 15, 23, and 26.

In the above embodiments, the pitch of the segments of the inner fin is changed at the inlet side and the outlet side of the water tube 1223; however, the pitch may be the same at the same at the entire region from the inlet side to the outlet side. In this case, only the inclination of the plate surfaces 1223*h* may be changed with respect to the water flow.

In the above embodiments, the inlet side and the outlet side of the water tube 1223 is divided by using the heat exchange cores Ca; however, the present invention is not limited to that. For instance, the two sides may be divided as a part having a temperature of water approximately 65° C. or less, and a part having a temperature of water approximately 65° C. or more.

In the above embodiments, the present invention is applied to the super critical heat pump type hot-water supply system, but may be applied to other heat pumps such as a heat pump type hot-water supply system that works at a pressure less than the super critical pressure. Hot water supplied from the system according to the present embodiment can be used in various ways such as for drinking and heating. Refrigerant is also not limited to carbon dioxide, but may be water, alcohol, or the like.

Ninth Embodiment

Figure 32:
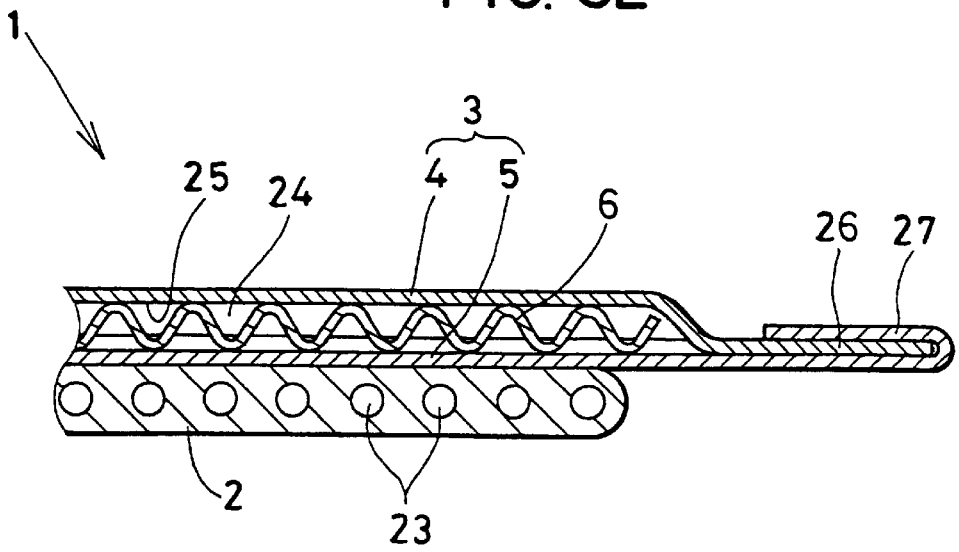
FIG. 32 is across-sectional view showing a main constitution of a heat exchanger according to a ninth preferred embodiment of the present invention.
Figure 33A:
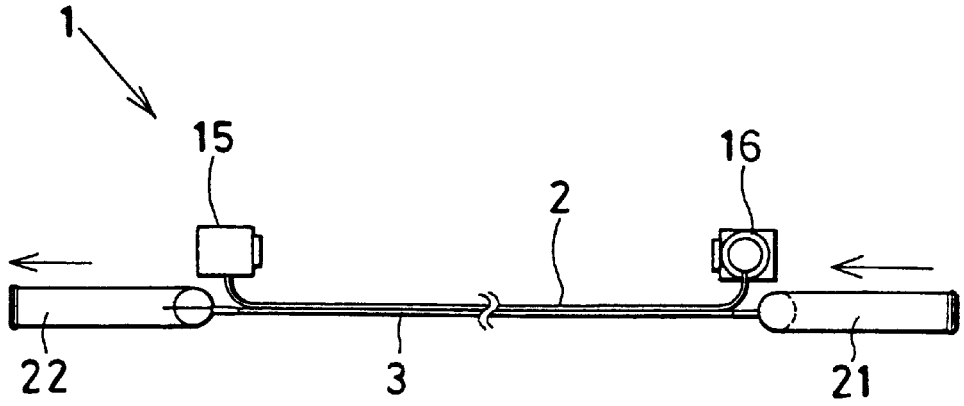
FIG. 33A is a plan view showing an entire constitution of the heat exchanger in the ninth embodiment.
Figure 33B:
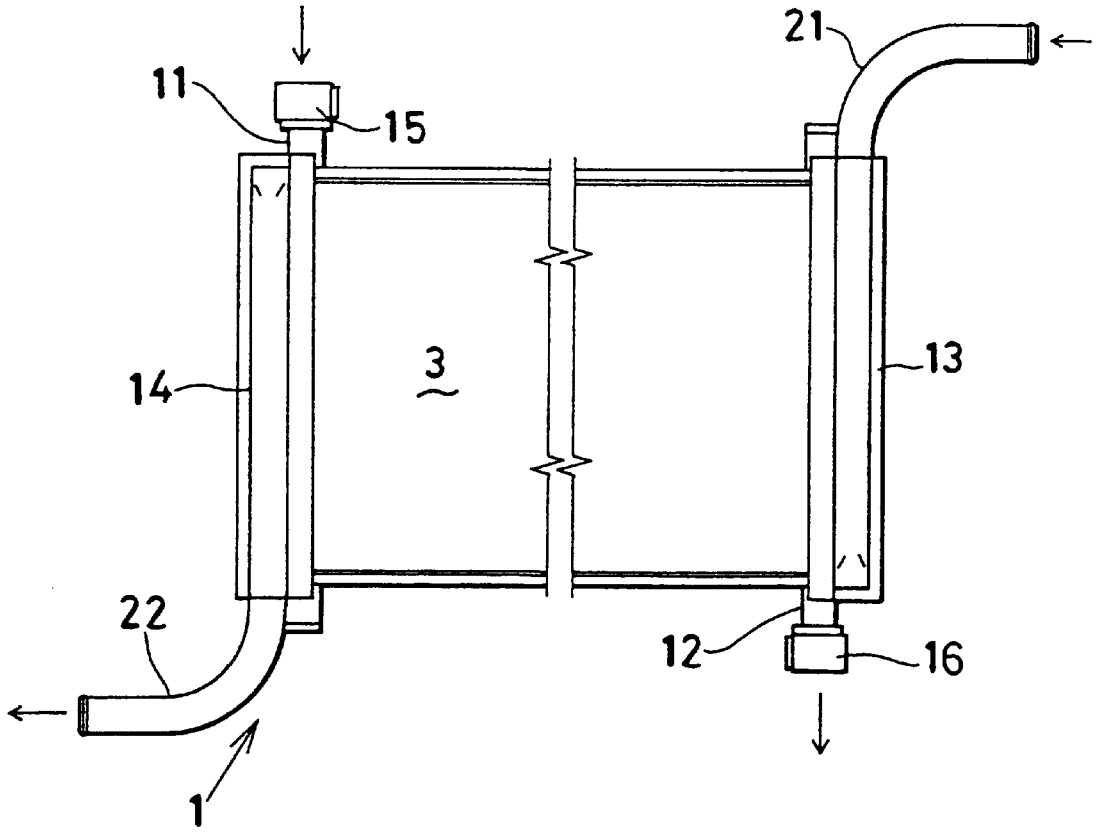
FIG. 33B is a front view showing the entire constitution of the heat exchanger in the ninth embodiment.

FIGS. 32, 33A, and 33B show a heat exchanger 1 in a ninth preferred embodiment according to the present invention. The heat exchanger 1 in the present embodiment is also used for a heat pump type hot-water supply system for supplying hot water to a kitchen or a bathroom. The heat exchanger 1 is a water heating device (refrigerant-water heat exchanger) in which refrigerant (for instance, carbon dioxide ($CO_2$) gas) discharged from a compressor exchanges heat with water (service water) flowing in a direction opposite to that of refrigerant to heat water.

Referring to FIGS. 33A and 33B, the heat exchanger 1 has an aluminum tube 2 formed by extrusion and connecting a refrigerant inlet side tank 11 and a refrigerant outlet side tank 12, and a stainless tube 3 connecting a water inlet side header 13 and a water outlet side header 14. The aluminum tube 2 and the stainless tube 3 are thermally and closely joined to each other by non-corrosion flux brazing, vacuum brazing, or the like.

An inlet side union 15 is provided at an end of the refrigerant inlet tank 11 to be connected to the discharge side of the refrigerant compressor via a refrigerant pipe. An outlet side union 16 is provided at an end of the refrigerant outlet tank at an opposite side of the inlet side union 15 to be connected to a pressure-reducing device such as an expansion valve via a refrigerant pipe. An inlet side pipe 21, which is bent with a circular shape in cross-section, is connected to the water inlet side header 13, and an outlet side pipe 22, which is also bent with a circular shape in cross-section, is connected to the water outlet side header 14.

The aluminum tube 2 is a multi-hole pipe (tube), and as shown in FIG. 32, has several refrigerant passages 23 therein in which refrigerant flows to exchange heat with water. The aluminum tube 2 is made of metal capable of exhibiting good extrusion property (for instance, metal containing aluminum as a main component). Each of the refrigerant passages 23 is a circular through hole, and has a dimension in a hole direction (depth direction in FIG. 32) larger than a dimension in a formation direction (right and left direction in FIG. 32) thereof. An inner fin may be inserted into each refrigerant passage 23.

The stainless tube 3 is, as shown in FIG. 32, formed from a pair of stainless members 4, 5 bonded to each other, which is made of corrosion resistive metal (for instance, metal containing stainless as a main component), corrosion resistance of which is superior to that of aluminum. The stainless tube 3 defines therein a water passage 24 in which service water flows. The stainless member 4 has a cup-like concave portion 25 for forming the water passage 24 with the stainless member 5. A corrugated inner fin 6 made of metal (for instance, stainless), corrosion resistance of which is superior to that of aluminum, is inserted into the water passage 24.

Next, a method for manufacturing the heat exchanger 1 in the present embodiment is explained briefly with reference to FIGS. 32, 33A and 33B.

First, pure aluminum containing metallic material is inject into a die for multi-hole extrusion, and hot extrusion molding is performed to form the flat and elliptic multi-hole aluminum tube 2. The refrigerant passages 23 formed in the aluminum tube 2 are shaped generally into a circle in cross-section to have an improved withstand pressure property with respect to refrigerant flowing therein.

On the other hand, the inner fin 6, which has been formed into a corrugated shape by a pair of roller making machines (not shown) for fins, is inserted into a gap between the pair of stainless members 4, 5 which has been formed into a cup-like shape by a pair of roller making machines (not shown) for tubes. Copper-made brazing filler metal foils (not shown) having a thickness of approximately 50 $\mu$m are inserted into a gap between the stainless member 4 and the inner fin 6 and a gap between the stainless member 5 and the inner fin 6. A flat end part 26 of the stainless member 4 is covered and fixedly caulked by a U-shaped end part 27 of the stainless member 5 by pressing at both ends of the pair of stainless members 4, 5. After that, the stainless members 4, 5 and the inner tube 6 are bonded together by the brazing filler metal foils, thereby forming the stainless tube 3.

Then, an aluminum-made thin brazing filler metal foil (not shown) is inserted into a gap between the joint surface of the aluminum tube 2 and the joint surface of the stainless tube 3, and the two joint surfaces are closely joined to each other by a non-corrosion flux brazing method or a vacuum brazing method. Since the aluminum-made brazing filler metal foil has a melting point lower than that of the copper-made brazing filler metal foils, the copper-made brazing filler metal does not melt during the brazing for joining the aluminum tube 2 and the stainless tube 3. Therefore, the bonding strength of the stainless tube 3 does not deteriorate in this step.

Next, as shown in FIGS. 33A and 33B, the refrigerant inlet side tank 11 and the refrigerant outlet side tank 12 are formed from aluminum-made cylindrical members. A linear elliptic hole (not shown) is formed in each cylindrical member for receiving an end of the aluminum tube 2. Then ends of the aluminum tube 2 are inserted into the elliptic holes of the cylindrical members, and are integrally brazed. Accordingly, the aluminum tube 2 is joined to the refrigerant inlet side tank 11 at the left side end in FIG. 33B, and is joined to the refrigerant outlet side tank 12 at the right side end in the figure.

The water inlet side header 13 and the water outlet side header 14 are formed from copper-made cylindrical members. The stainless tube 3 is joined to the water inlet side header 13 at the right side end thereof in the figure, and to the water outlet side header 14 at the left side end thereof in the figure, by torch brazing. As a result, the heat exchanger 1 is completed.

Next, the operation and effects of the heat exchanger 1 according to the present invention are explained below.

High-pressure and high-temperature refrigerant gas discharged from the compressor enters the refrigerant inlet side tank 11 after passing through the refrigerant pipe. Then, refrigerant gas flows from the tank 11 into the refrigerant passages 23 defined in the aluminum tube 23, and is cooled down by exchanging heat with water when it passes through the refrigerant passages 23. Then, refrigerant gas flows toward the pressure-reducing device such as an expansion valve through the refrigerant outlet side tank 12 of the heat exchanger 1 and the refrigerant pipe.

Meanwhile, water (service water) flows into the water inlet side header 13 through the inlet side pipe 21 and is heated to be hot water by exchanging heat with refrigerant gas when it passes through the water passage 24 defined in the stainless tube 3. Then, hot water is conducted toward the bathroom, kitchen, or the like after passing through the water outlet side header 14 of the heat exchanger 1 and the outlet side pipe 22.

According to the heat exchanger 1 in the present embodiment, the tube 3 defining therein the water passage 24 is formed by integrally brazing the stainless members 4, 5, corrosion resistance of which is superior to that of pure aluminum, interposing the inner fin 6 therebetween. Accordingly, the passage walls of the water passage 24, i.e., the walls of the stainless members 4, 5, the surface of the inner fin 6, and the copper-made brazing filler metal foils have largely improved corrosion resistance with respect to chlorine contained in service water as compared to that of aluminum system metallic materials.

When refrigerant gas is composed of carbon dioxide ($CO_2$), the tube for refrigerant is required to have a higher withstand pressure property as compared to a case where felon system refrigerant gas is utilized . . . In the present embodiment, since the tube 2 is formed of pure aluminum containing metallic material by extrusion molding to have the refrigerant passages 23 therein, the tube 2 can have the higher withstand pressure property.

Tenth Embodiment

Figure 34A:
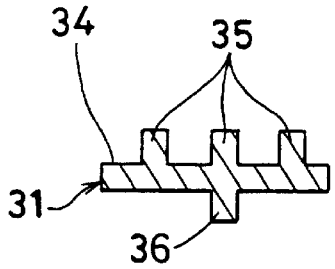
FIGS. 34A and 34B are cross-sectional views showing parts for forming a tube for a heat exchanger in a tenth preferred embodiment.
Figure 34B:
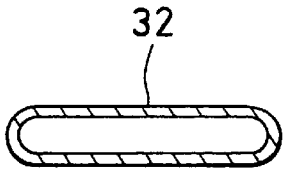
Figure 34C:
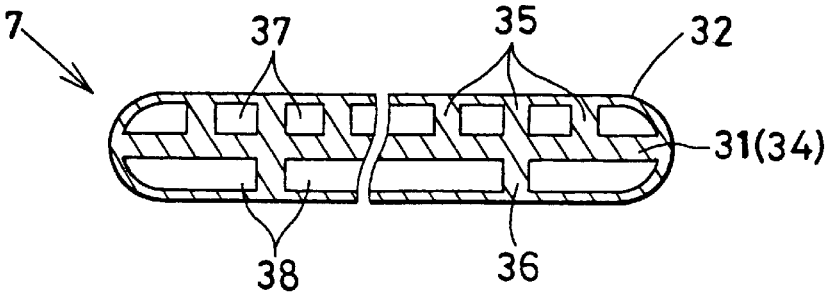
FIG. 34C is a cross-sectional view showing the tube in the tenth embodiment.

FIGS. 34A to 34C show a tube 7 for a heat exchanger according to a tenth preferred embodiment of the present invention. The tube 7 in the present embodiment is formed from two separate parts. One of the parts, a copper-made member 31 shown in FIG. 34A, is formed into a specific shape by pressing (roller-pressing) copper material, corrosion resistance of which is superior to that of pure aluminum containing metallic material. The other one of the parts, a flat copper-made tube 32 shown in FIG. 34B, is formed of copper material by extrusion molding. The copper-made member 31 is inserted into the copper-made tube 32, and thermally and closely joined together by copper brazing filler metal or the like, thereby forming the tube 7 shown in FIG. 34C.

Referring to FIG. 34A, the copper-made member 31 is composed of plate-like base portion 34, several first pillar portions (first protruding portions) 35 protruding from a surface (upper side in the figure) of the base portion 34, and several second pillar portions (second protruding portions) 26 protruding from the other surface (lower side of the figure) of the base portion 34. Referring to FIG. 34B, the copper-made tube 32 has a linear elliptic shape in cross section.

Referring to FIG. 34C, in the tube 7, several refrigerant passages (first (or second) fluid passages) 37 are defined between the passage wall of the tube 32 and the surface of the base portion 34 of the member 31, and are divided by the first pillar portions 35, in which refrigerant (first (or second) fluid) flows. Further, several water passages (second (or first) fluid passages) 38 are defined between the passage wall of the tube 32 and the other surface of the base portion 34, and are divided by the second pillar portions 36, in which service water (second (or first) fluid) flows.

The tube 7 constructed as above according to the present embodiment is formed by inserting the copper-made member 31 into the tube 32 and by crushing its periphery. Accordingly, the member 31 is assembled (integrated) such that the copper-made member 31 closely fits the inner surface (passage wall) of the tube 31. After that, they are thermally joined together by copper brazing. Incidentally, the joint surfaces in the tube 7 are coated with copper brazing filler metal paste before performing the brazing. A die forming material may be joined when extrusion molding is performed.

According to the present embodiment, the same effects as those in the ninth embodiment can be achieved. In addition, despite that the extrusion property of copper material is inferior to that of aluminum material, the multi-hole tube 7 made of copper can be formed easily by adopting the method described above and have substantially the same structure and high withstand pressure property as those of the aluminum tube 2 in the ninth embodiment.

Eleventh Embodiment

Figure 35A:
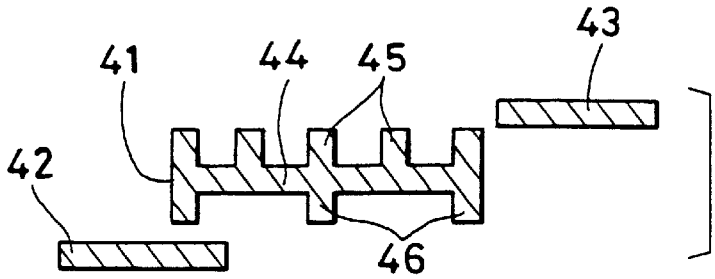
FIG. 35A is a cross-sectional view showing parts for forming a tube for a heat exchanger in an eleventh preferred embodiment.
Figure 35B:
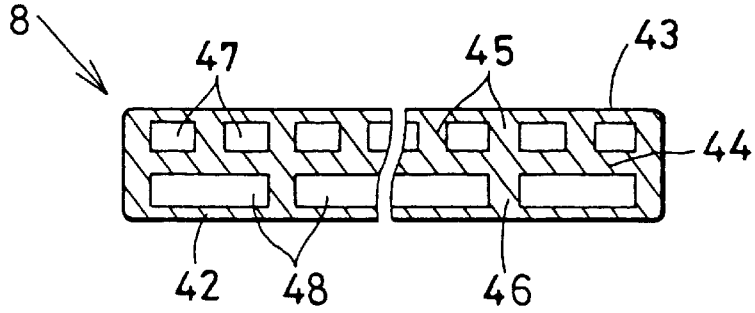
FIG. 35B is a cross-sectional view showing the tube in the eleventh embodiment.

FIGS. 35A and 35B show a tube 8 for a heat exchanger in an eleventh preferred embodiment. The tube 8 is formed from three separate parts shown in FIG. 35A, i.e., a copper-made member 41 and a pair of plate-like lid members 42, 43 that are formed by pressing (roller-pressing) copper materials. The member 41 is disposed between the lid members 42, 43 and is thermally and closely joined together by brazing or the like.

The member 41 is composed of a plate-like base portion 44, several first pillar portions (first protruding portions) 45 protruding from a surface (upper side in the figure) of the base portion 44, and several second pillar portions (second protruding portions) 46 protruding from the other surface (lower side in the figure) of the base portion 44.

In the tube 8, several refrigerant passages (first (or second) fluid passages) 47 are defined between the passage wall of the lid member 43 and the surface of the base portion 44 and are divided by the first pillar portions 45. Refrigerant (first (or second) fluid) flows in the refrigerant passages 47. Further, several water passages (second (or first) fluid passages) 48 are defined between the passage wall of the lid member 42 and the other surface of the base portion 44 and are divided by the second pillar portions 46. Service water (second (or first) fluid) flows in the water passages 48.

Twelfth Embodiment

Next, a twelfth preferred embodiment of the present invention is explained with reference to FIGS. 36, 37A, and 37B. A heat exchanger 9 in the present embodiment is, similarly to the above embodiments, applied to a heat pump type hot-water supply system for supplying hot water to a domestic bathroom, kitchen, or the like. In the heat exchanger 9, refrigerant gas (for instance, $CO_2$ gas) discharged from a compressor exchanges heat with service water to heat service water.

Figure 36:
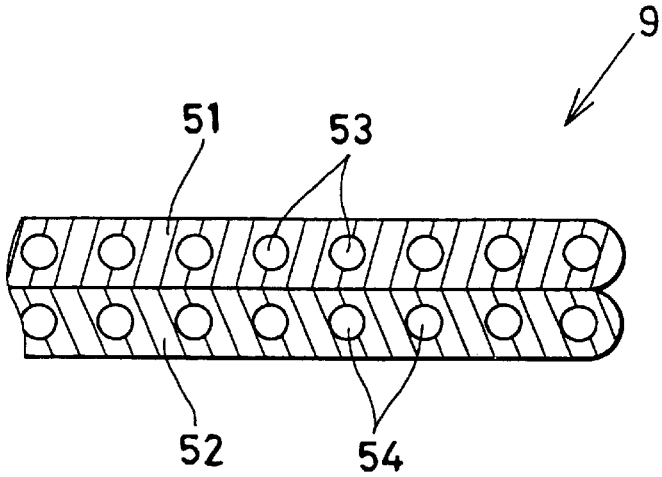
FIG. 36 is a cross-sectional view showing a main part of a heat exchanger in a twelfth preferred embodiment.
Figure 37A:
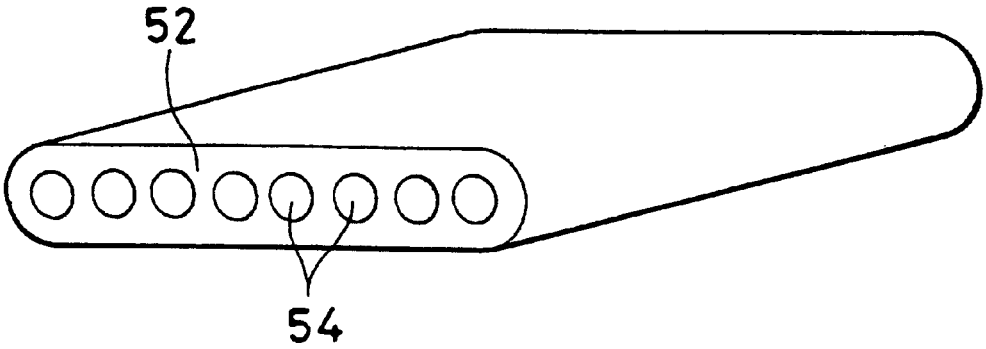
FIG. 37A is a perspective view showing a tube for the heat exchanger in the twelfth embodiment.
Figure 37B:
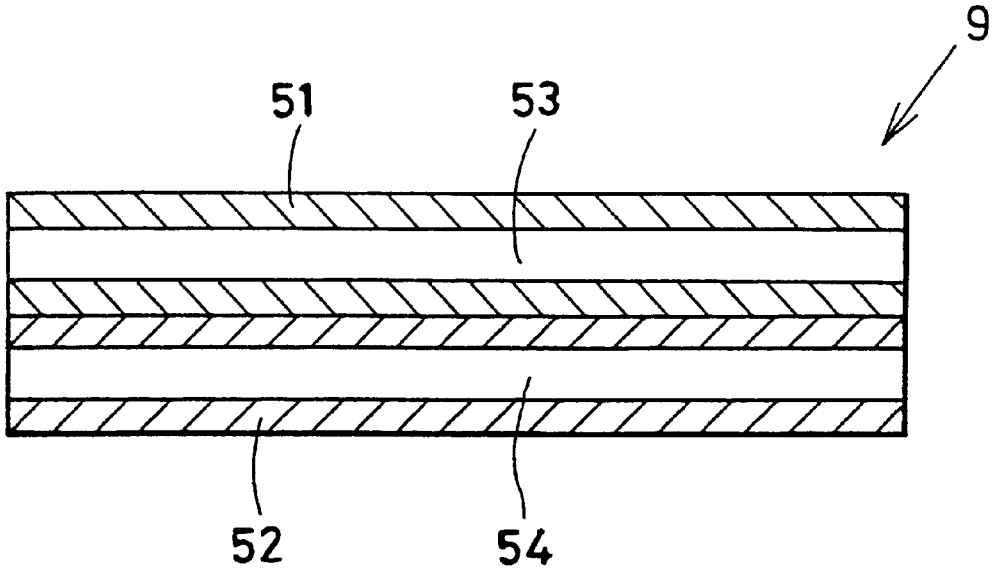
FIG. 37B is across-sectional view showing the heat exchanger in the twelfth embodiment.

Referring to FIGS. 36, 37A, and 37B, the heat exchanger 9 is composed of a first copper-made tube 51 and a second copper-made tube 52 that are formed of copper material by extrusion molding. The first tube 51 and the second tube 52 are stacked and thermally and firmly joined together by copper brazing or the like. The first tube 51 is a multi-hole tube that is thin in plate thickness, and is long in a refrigerant flow direction. Several refrigerant passages 53 are formed in the first tube 51, in which refrigerant flows. The second tube 52 is also a multi-hole tube that is thin in plate thickness and is long in a water flow direction. Several water passages 54 are formed in the second tube 52, in which water flows.

Thirteenth Embodiment

Figure 38A:
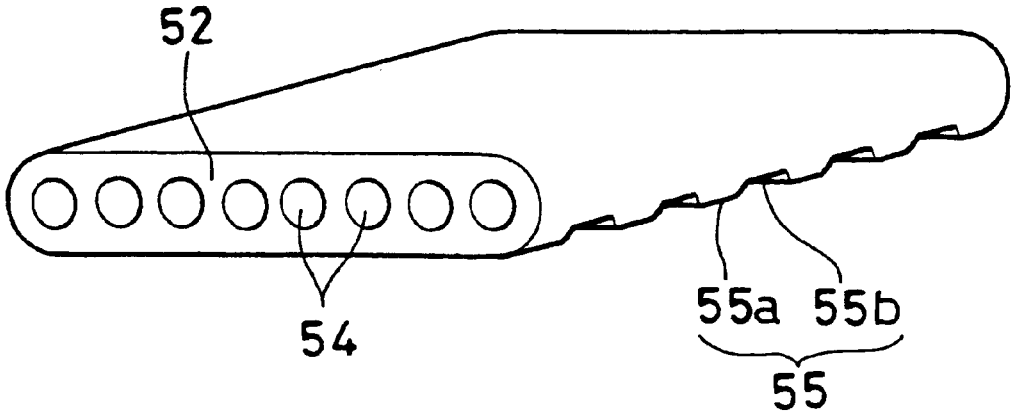
FIG. 38A is a perspective view showing a tube for a heat exchanger in a thirteenth preferred embodiment.
Figure 38B:
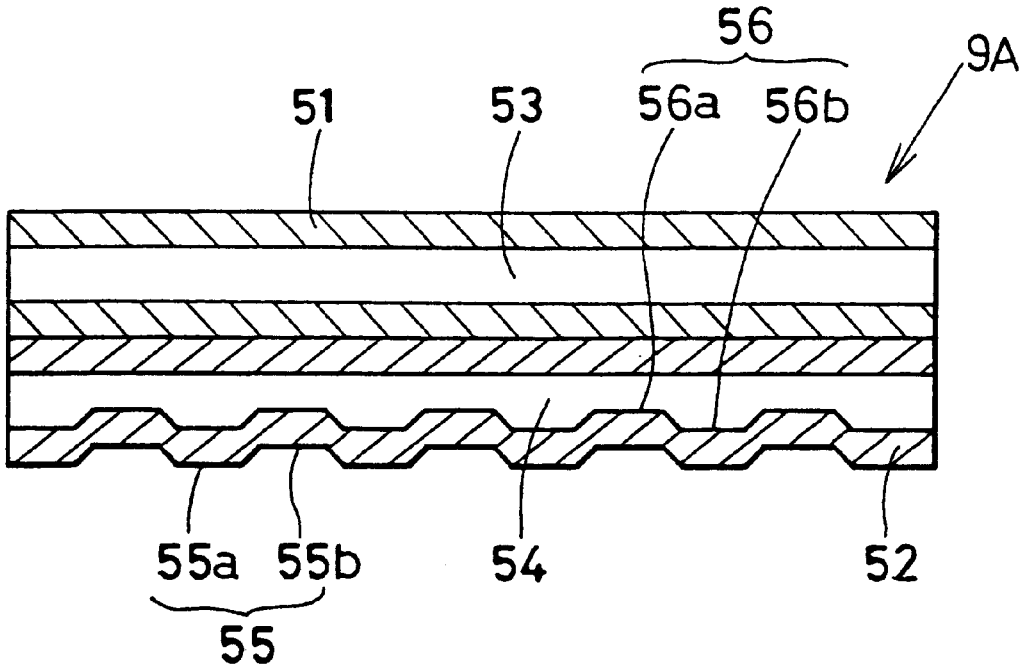
FIG. 38B is a cross-sectional view showing the heat exchanger in the thirteenth embodiment.

A heat exchanger 9A in a thirteenth preferred embodiment is explained with reference to FIGS. 38A and 38B. In the figures, the same parts as those in the twelfth embodiment are denoted with the same reference numerals.

In the present embodiment, similarly to the twelfth embodiment, the heat exchanger 9A is composed of a first copper-made tube 51 and a second copper-made tube 52 that are formed of copper material by extrusion molding. The first tube 51 and the second tube 52 are stacked and thermally and firmly joined together by copper brazing or the like.

Further, convex portions 55*a* and concave portions 55*b* are alternately (repeatedly) provided on an outer wall of the second tube 52 at an opposite side of the first tube 51 to form concave and convex portions 55 thereon. Further, convex portions 56*a* and concave portions 56*b* are alternately (repeatedly) provided on a passage wall (inner wall) of the second tube 52 forming several water passages 54 to form convex and concave portions 56 thereon. The convex and concave portions 56 disturb flow of water, and bring the flow of water into turbulence in the water passages 54. Accordingly, the heat exchanging efficiency between water and refrigerant can be improved.

Fourteenth Embodiment

Figure 39A:
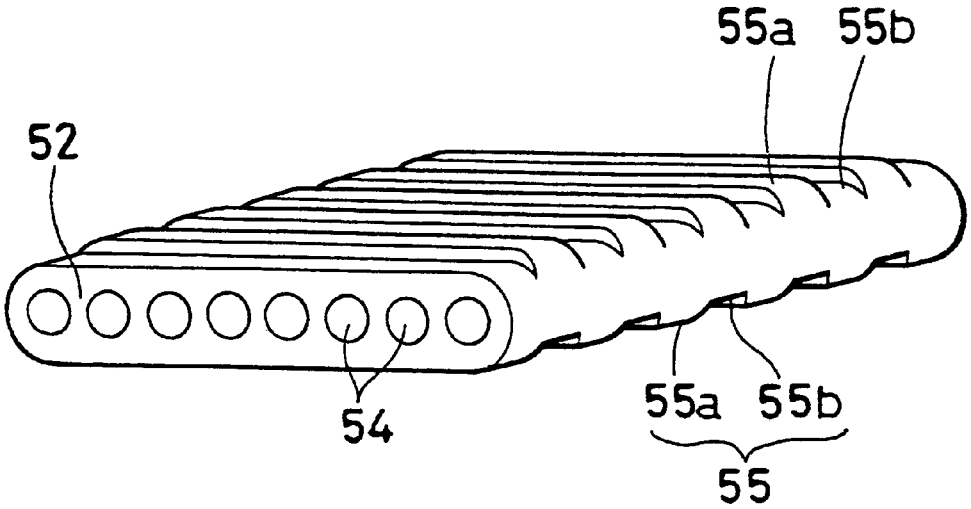
FIG. 39A is a perspective view showing a tube for a heat exchanger in a fourteenth preferred embodiment.
Figure 39B:
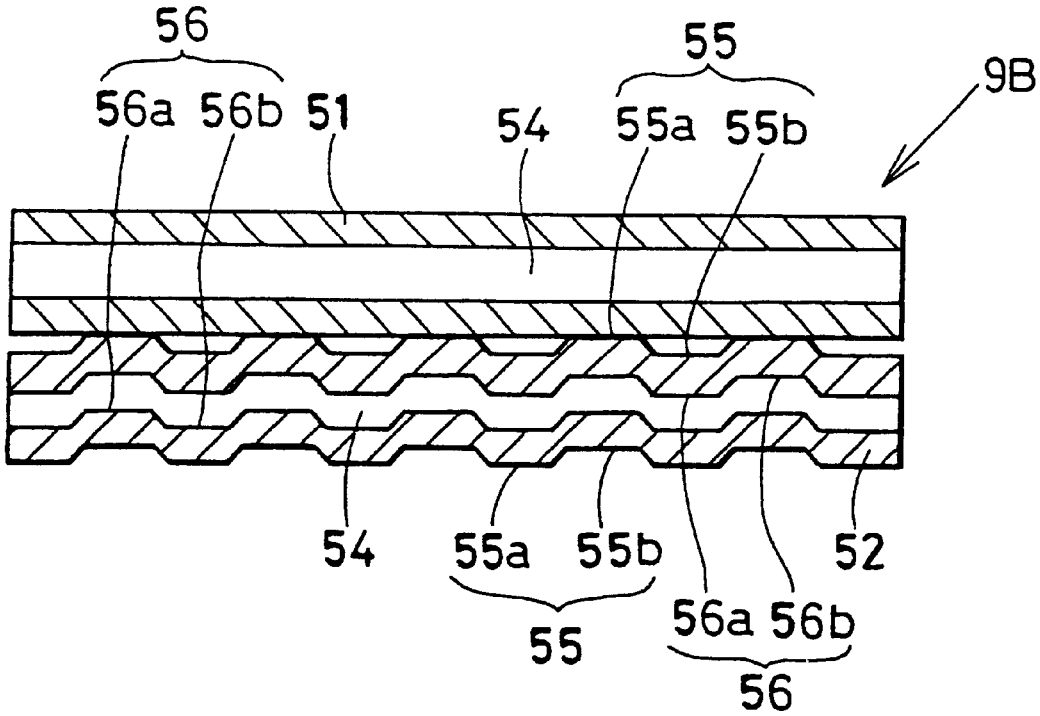
FIG. 39B is across-sectional view showing the heat exchanger in the fourteenth embodiment.

A heat exchanger 9B in a fourteenth preferred embodiment is explained below with reference to FIGS. 39A and 39B in which the same parts as those in the twelfth and thirteenth embodiments are denoted with the same reference numerals. In the present embodiment, similarly to the thirteenth embodiment, the heat exchanger 9B is composed of a first copper-made tube 51 and a second copper-made tube 52 that are stacked and joined together by copper brazing or the like.

In the present embodiment, convex portions 55*a* and concave portions 55*b* are alternately (repeatedly) provided on both outer walls of the second tube 52 in cross-section to form convex and concave portions 55 thereon. Further, while several water passages 54 are defined in the second tube 52, convex portions 56*a* and concave portions 56*b* are alternately (repeatedly) provided on both sides passage walls of each water passage 54 to form convex and concave portions 56 thereon. Accordingly, the flow of water is disturbed by the convex and concave portions 56 more effectively than that in the thirteenth embodiment, resulting in further improvement of the heat exchanging efficiency between water and refrigerant.

Fifteenth Embodiment

A heat exchanger 1A in a fifteenth preferred embodiment is explained with reference to FIGS. 40 to 42 in which the same parts as those in the ninth embodiment are denoted with the same reference numerals.

The heat exchanger 1A according to the present embodiment is, similarly to the ninth embodiment, applied to a heat pump type hot-water supply system, and is composed of an aluminum tube 2 connecting a refrigerant inlet side tank 11 and a refrigerant outlet side tank 12, and a stainless tube 3 connecting a water inlet side header 13 and a water outlet side header 14. The aluminum tube 2 and the stainless tube 3 are thermally and closely joined together by non-corrosion flux brazing, vacuum brazing, or the like.

Further, similarly to the ninth embodiment, an inlet side union 15 is provided at an end of the refrigerant inlet side tank 11, and an outlet side union 16 is provided at an end of the refrigerant outlet side tank 12 at an opposite side of the inlet side union 15. An inlet side pipe 21 is connected to the water inlet side header 13, while an outlet side pipe 22 is connected to the water outlet side header 14.

The aluminum tube 2 is a multi-hole tube composed of a tube core member 61 made of, for instance, aluminum alloy containing aluminum and manganese (Al—Mn). The tube core member 61 is formed by extrusion molding, and has several refrigerant passages 23 therein. A tube sacrifice layer 62, corrosion resistance of which is inferior to that of the tube core member 61, is formed on a surface of the tube core member 61. The tube sacrifice layer 62 is made of, for instance, aluminum alloy containing aluminum and zinc (Al—Zn).

The stainless tube 3 is composed of a pair of stainless members 4, 5 joined together to define a water passage 24 therein. The stainless members 4, 5 are made of corrosion resistance metal (for instance, stainless: SUS) having corrosion resistance superior to that of aluminum alloy. One of the stainless members 4, 5, i.e., the stainless member 4 is formed with the concave portion 25 having a cup-like shape. A corrugated fin 6 made of corrosion resistance metal (for instance, stainless: SUS) having corrosion resistance superior to that of aluminum alloy is disposed in the water passage 24.

Figure 40:
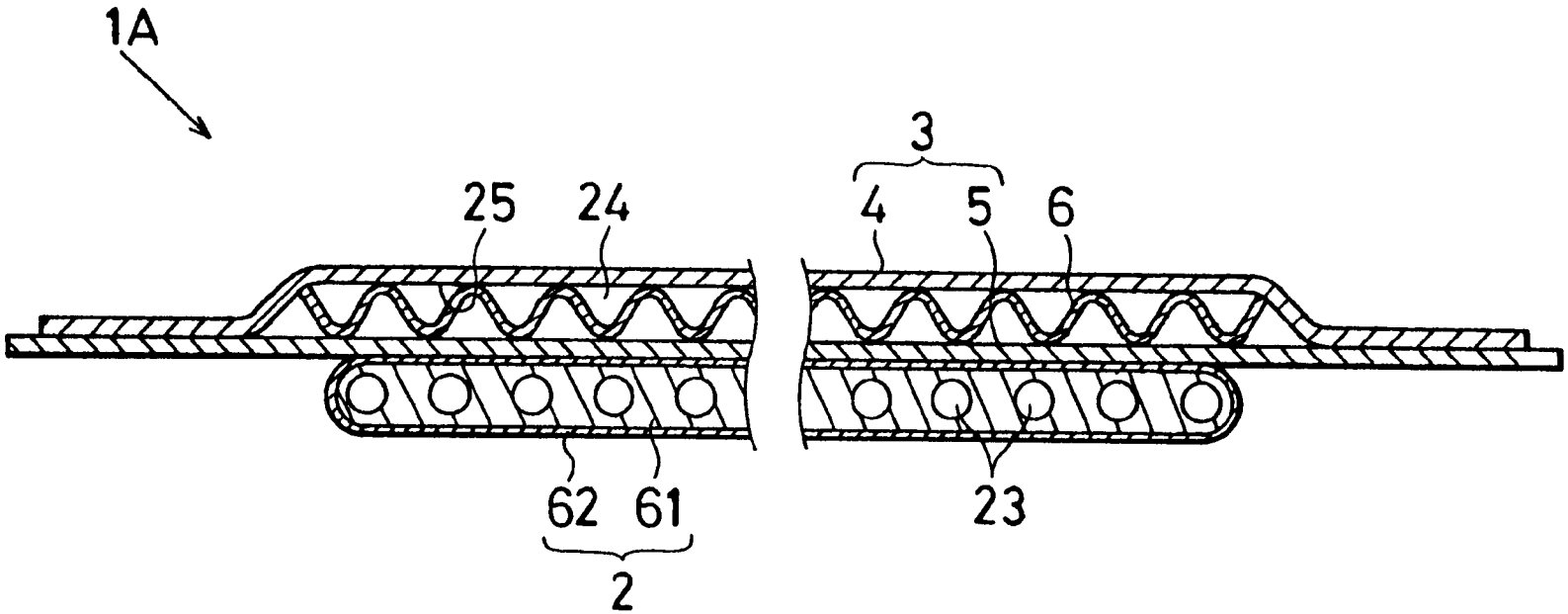
FIG. 40 is a cross-sectional view showing a main part of a heat exchanger in a fifteenth preferred embodiment.
Figure 41:
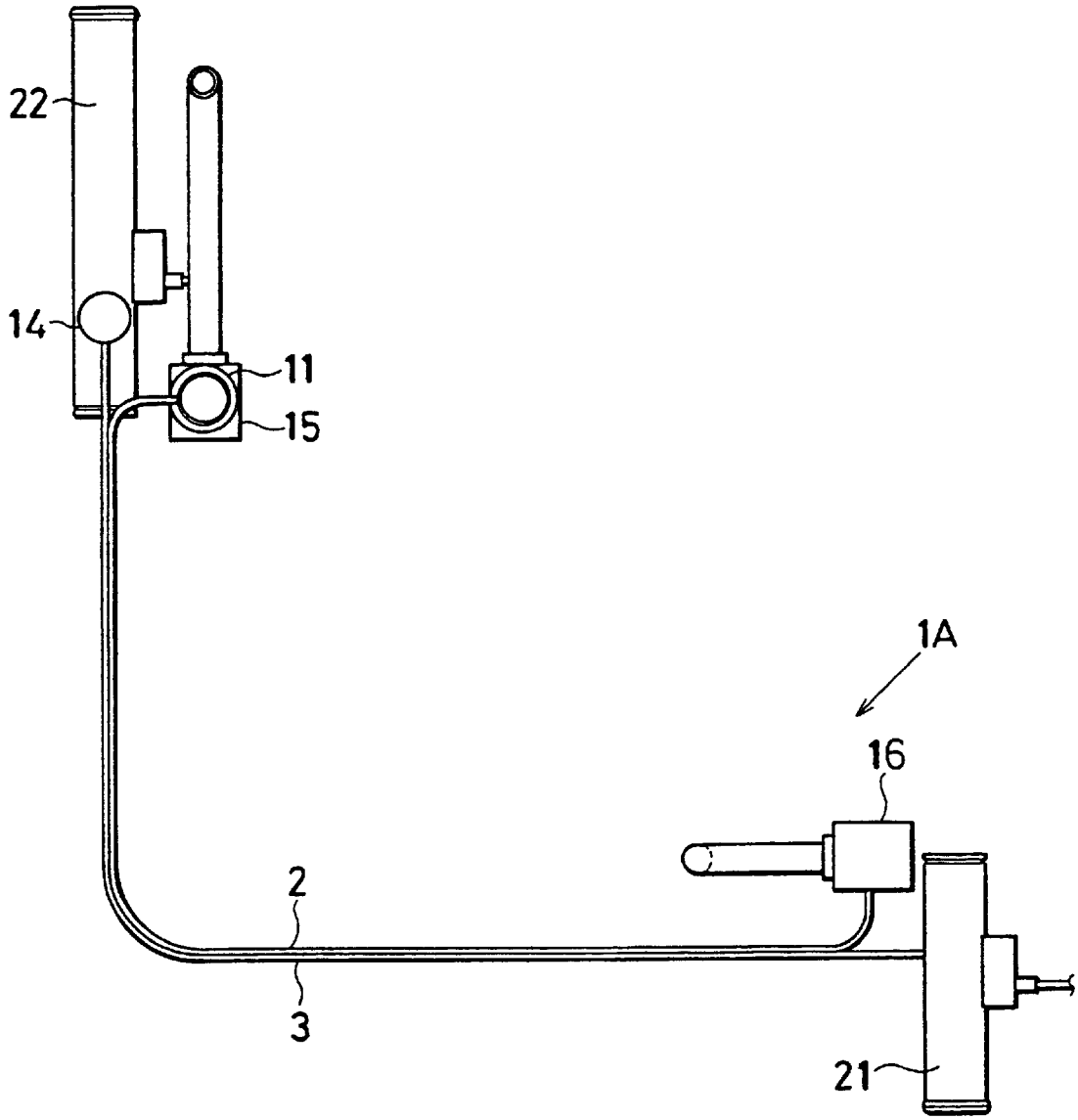
FIG. 41 is a plan view showing an entire constitution of the heat exchanger in the fifteenth embodiment.
Figure 42:
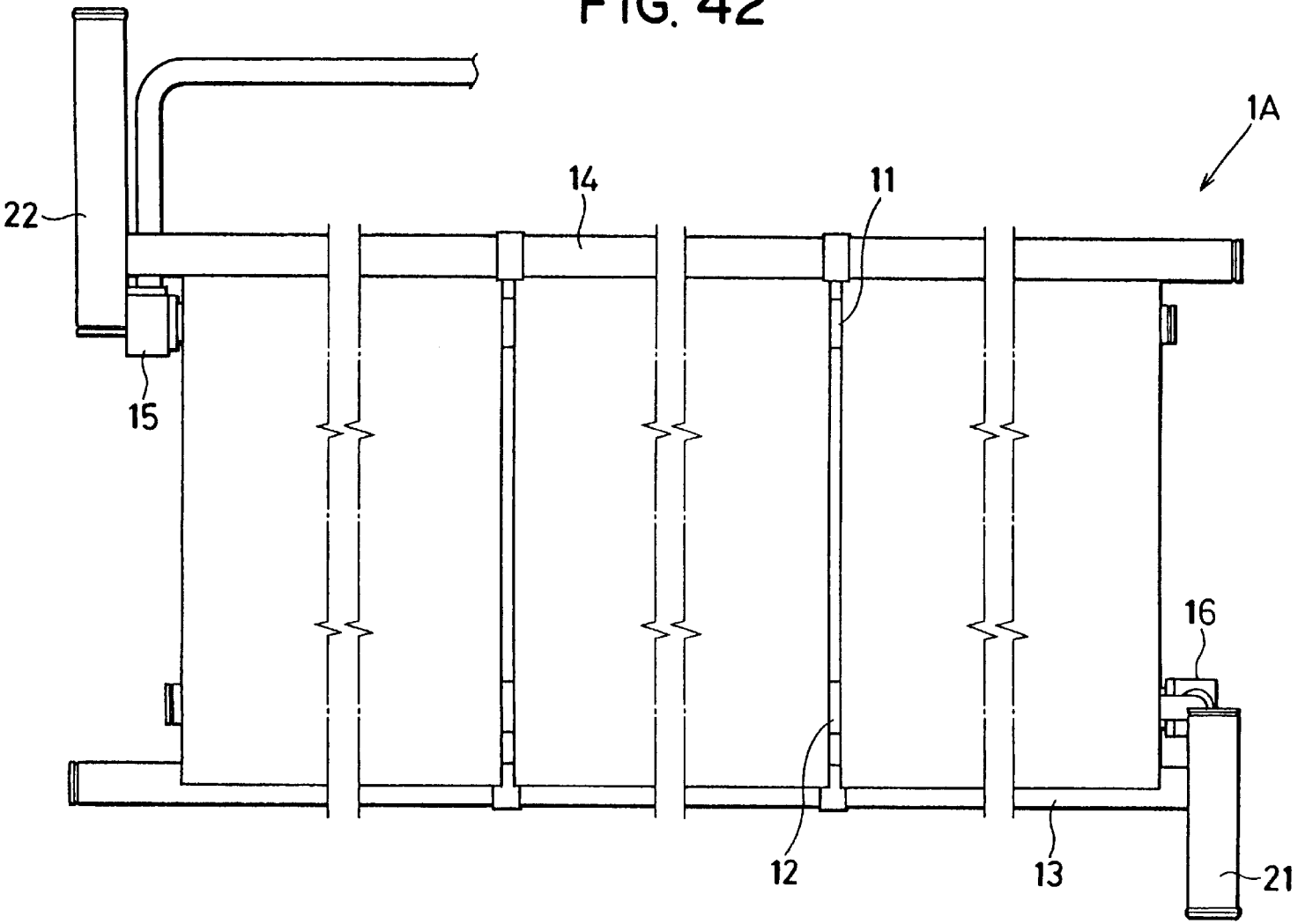
FIG. 42 is a front view showing the entire constitution of the heat exchanger in the fifteenth embodiment.

Next, a method for manufacturing the heat exchanger 1A in the present embodiment is explained briefly with reference to FIGS. 40 to 42.

First, the stainless tube 3 and the aluminum tube 2 (tube core member 61) are fabricated substantially in the same manner as in the ninth embodiment. Next, aluminum-zinc powders are sprayed on the surface of the tube core member 61. Then, an aluminum brazing filler metal foil having a thickness of approximately 50 $\mu$m is inserted into the stainless tube 3 and the aluminum tube 2.

After that, the aluminum brazing filler metal foil is molten within a furnace (nitrogen atmosphere), at a brazing temperature higher than the melting point of the aluminum brazing filler metal foil and lower than the melting point of the tube core member 61. Accordingly, the aluminum tube 2 and the stainless tube 3 are joined together by brazing. During this brazing step, zinc atoms in the aluminum-zinc powders applied to the tube core member 61 are diffused into a surface portion of aluminum alloy forming the tube core member 61. As a result, the tube sacrifice layer 62 is formed on the surface of the tube core member 61.

The bonding between the surface of the aluminum tube 2 and the surface of the stainless tube 3 can be achieved by inserting a thin aluminum brazing filler metal foil into a gap between the tubes 2, 3, and by performing non-corrosion flux brazing or vacuum brazing. The tubes 2, 3 may be bonded together by high thermal conductive adhesive.

Next, the effects of the present embodiment are explained. If the stainless tube 3 is corroded at an inside thereof and the corrosion progresses to allow water to leak from the water passage 24 of the stainless tube 3, the aluminum tube 2 may be corroded by the leaked water. If one of the refrigerant passages 23 of the tube 2 communicates with the water passage 24 of the tube 3, since pressure of refrigerant is higher than that of water, refrigerant may leak from the tube 2 and invade the tube 3.

To solve this problem, in the heat exchanger 1A of the present embodiment, the tube sacrifice layer 62 having corrosion resistance inferior to that of the tube core member 61 is disposed on the surface of the aluminum tube 2, i.e., on the surface of the tube core member 61. The tube sacrifice layer 62 has an electrical potential lower than that of the tube core member 61 by, for instance, 100 mV. Because of this, even if a local battery is formed at this portion due to water, the tube sacrifice layer 62 having a lower electrical potential is selectively corroded. Therefore, the refrigerant passage 24 of the aluminum tube 2 does not communicate with the water passage 24 of the stainless tube 3, and water flows toward outside. Refrigerant is prevented from invading the water passage by detecting the water.

Sixteenth Embodiment

Figure 43:
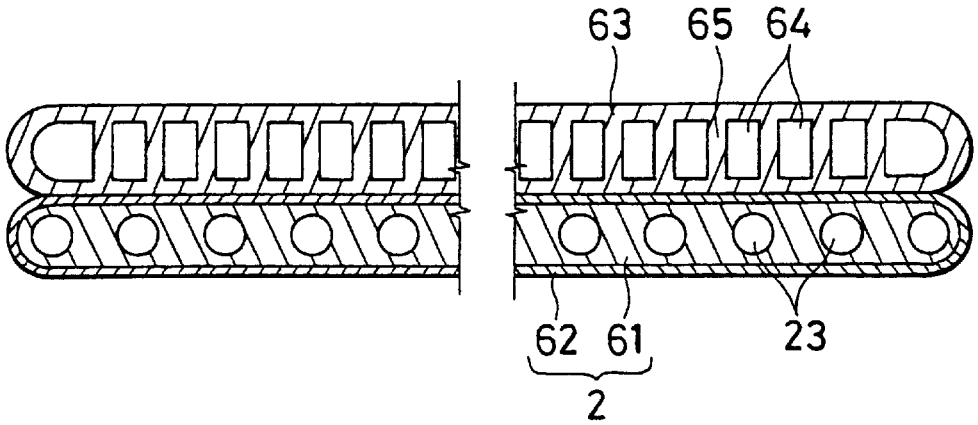
FIG. 43 is a cross-sectional view showing a main part of a heat exchanger in a sixteenth preferred embodiment.

FIG. 43 shows a main constitution of a heat exchanger in a sixteenth preferred embodiment of the present invention. In this embodiment, a water passage tube is composed of an aluminum tube 63, in place of a stainless tube. The aluminum tube 63 is a flat tube having an elliptic shape in cross-section. The aluminum tube 63 is fabricated, for instance, by injecting aluminum alloy, containing aluminum and manganese, into a die for multi-hole tubes and performing hot extrusion molding. Several water passages 64, each cross-section of which is generally rectangular, are formed in the aluminum tube 63 and divided by pillar portions 65.

Seventeenth Embodiment

Figure 44:
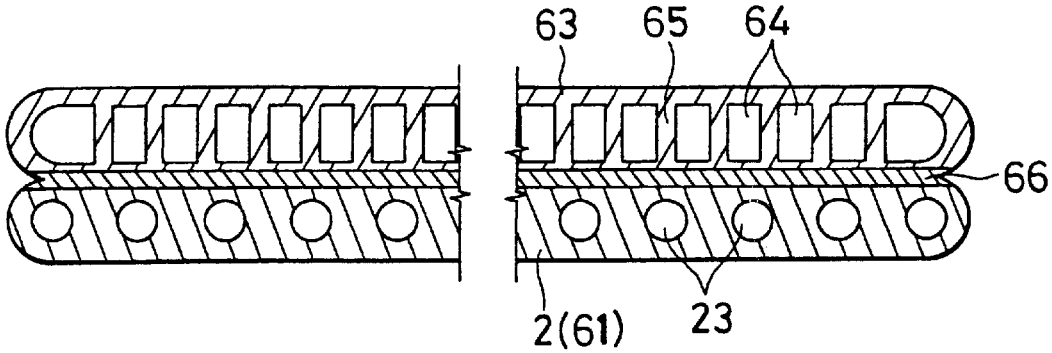
FIG. 44 is a cross-sectional view showing a main part of a heat exchanger in a seventeenth preferred embodiment.

FIG. 44 shows a main constitution of a heat exchanger in a seventeenth preferred embodiment. In this embodiment, the heat exchanger is composed of an aluminum tube 2 for water and an aluminum tube 63 for refrigerant. When the aluminum tubes 2, 63 are brazed to each other, flux (for instance, fluorine system flux) powder containing zinc powder is used for the brazing. Accordingly, a potentially low (base) zinc diffusion layer 66 is formed only at the joint portion between the aluminum tubes 2 and 63. The zinc diffusion layer 66 is made of aluminum alloy containing aluminum and zinc and has corrosion resistance inferior to that of an aluminum core member of each tube.

When the aluminum tubes 2, 63 are brazed to each other, an aluminum brazing filler metal foil made of aluminum alloy including aluminum and zinc and having a thickness of approximately 50 $\mu$m may be disposed between the aluminum tubes 2 and 63. In this state, they are heated within a furnace (nitrogen atmosphere) at a temperature higher than the melting point of the aluminum brazing filler metal foil. As a result, the aluminum tubes 2, 63 are joined together by brazing. During this brazing step, zinc atoms in the aluminum brazing filler metal foil is diffused at the joint portion between the tubes 2 and 63 to form the zinc diffusion layer (tube sacrifice layer) 66 at the joint portion.

In the embodiments described above, the aluminum tube 2 and the stainless tube 3 are bonded together by brazing; however, the tubes 2, 3 may be bonded by high thermal conductive adhesive or sheet. Otherwise, the tubes 2, 3 may be bonded together by soldering, welding, or the like. Although the tube 3 is formed from stainless members formed into a cup-like shape, it may be formed from copper members formed into a cup-like shape. Although the tube 32 and the plate-like lid members 42, 43 are made of copper, they are made of stainless with the same structures.

In the above embodiments, the refrigerant passages 23 in the aluminum tube 2, the refrigerant passages 53 in the first copper-made tube 51, the water passages 52 in the second copper-made tube 52 are formed to have a circular cross-section, respectively, in consideration of high withstand pressure property. However, the cross-sectional shapes of the passages can have various shapes such as rectangle, triangle, H-like shape, and the like. It is apparent that any one of the first to seventeenth embodiments described above can be combined with another one of the embodiments appropriately.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A heat exchanger comprising:

a first tube defining therein a first fluid passage in which a first fluid flows; and a second tube contacting the first tube and defining therein a second fluid passage in which a second fluid flows, wherein the first tube has a first joint surface brazed to a second joint surface of the second tube; wherein:

a groove is provided on the first joint surface to divide the first joint surface into at least two regions such that the first joint surface is brazed to the second joint surface at the regions other than the groove;

the first fluid passage defined in the first tube serpentines to cross perpendicularly a second fluid direction in which the second fluid flows in the second fluid passage;

the first tube includes a plurality of first tube bodies each contacting the second tube and each having a longitudinal direction perpendicular to that of the second tube;

the first fluid flows in each of the plurality of first tube bodies in a first fluid direction perpendicular to the second fluid direction and parallel to the longitudinal direction of each of the plurality of first tube bodies; and the plurality of first tube bodies form a plurality of heat exchange cores with the second tube, the plurality of heat exchange cores being arranged in a direction approximately perpendicular to both the first fluid direction and the second fluid direction.

2. The heat exchanger of claim 1, wherein:

the first tube is composed of plate members that are bonded to each other at a bonding portion and forming the first fluid passage therein; and the groove is defined by the bonding portion.

3. The heat exchanger of claim 2, wherein:

the plate members forming the first tube have flat surfaces forming the first fluid passage therein; and the bonding portion is provided by wall portions of the plate members, the wall portions firmly contacting each other and making a specific angle with respect to a plane parallel to the flat surfaces.

4. The heat exchanger of claim 1, wherein:

the first tube is made of a first material; and the second tube is made of a second material different from the first material.

5. The heat exchanger of claim 1, wherein the first tube and the second tube are made of the same material that is one of copper and stainless.

6. The heat exchanger of claim 1, wherein the second tube is composed of a plurality of capillary tubes arranged in parallel with one another.

7. The heat exchanger of claim 1, wherein:

the first fluid is water; and the second fluid is refrigerant.

8. The heat exchanger of claim 1, wherein:

the second tube is disposed under the first tube in a vertical direction; and the first fluid flows in the first tube to receive heat from the second tube flowing in the second tube.

9. The heat exchanger of claim 8, wherein:

the first fluid is water; and the second fluid is refrigerant.

10. The heat exchanger of claim 1, wherein the first tube and the second tube are disposed vertically.

11. The heat exchanger of claim 1, wherein the first tube and the second tube are disposed with the first joint surface and the second joint surface that are non-parallel to a horizontal direction.

12. The heat exchanger of claim 1, wherein the second tube serpentines to extend in a direction perpendicular to the second fluid direction and to the longitudinal direction of each of the plurality of first tube bodies.

13. The heat exchanger of claim 1, further comprising a first tube header connecting adjacent two of the plurality of first tube bodies to turn the first fluid direction at 180° between the adjacent two of the plurality of first tube bodies.

14. The heat exchanger of claim 1, wherein:

the first fluid is water and flows in the first tube made of one of copper and stainless;

the second fluid is aluminum and flows in the second tube made of aluminum;

the first tube and the second tube are brazed to each other through a joint member having an aluminum layer and a brazing filler metal layer.

15. The heat exchanger of claim 1, wherein:

the second fluid flowing in the second tube has a temperature higher than that of the first fluid flowing in the first tube; and the second tube is exposed to a space at an opposite side of the first tube contacting the second tube, the space being provided for thermal insulation.

16. The heat exchanger of claim 1, further comprising a reinforcement member provided at a side of a first one of the first and second tubes opposite to a second one of the first and second tubes, the first one having a flexural rigidity smaller than that of the second one, the reinforcement member being provided for increasing the flexural rigidity of the first one.

17. The heat exchanger of claim 1, wherein:

the first fluid flowing in the first tube is water;

the first tube is made of a first metallic material having a high corrosion resistance with respect to water;

the second tube is made of a second metallic material having a high form ability; and a joint member disposed between the first tube and the second tube for joining the first tube and the second tube together.

18. The heat exchanger of claim 17, wherein the joint member is a diffusion layer including zinc.

19. The heat exchanger of claim 1, wherein:

the first tube and the second tube are brazed to each other through a diffusion layer interposed therebetween, the diffusion layer including zinc.

20. The heat exchanger of claim 1, wherein:

the first fluid is water and flows in the first tube;

the second fluid is refrigerant and flows in the second tube with higher pressure and higher temperature than those of water flowing in the first tube; and a joint member disposed between the first tube and the second tube for joining the first tube and the second tube together.

21. The heat exchanger of claim 20, wherein:

the second tube is composed of a tube core member in which the second fluid passage is formed, and a sacrifice layer provided on a surface of the tube core member, the sacrifice layer having an electrical potential lower than that of the tube core member.

22. The heat exchanger of claim 20, wherein:

the joint member is a diffusion layer including a brazing filler metal and zinc.

23. The heat exchanger of claim 20, wherein:

the second tube is a multi-hole tube formed of an aluminum material by extrusion; and the first tube is made of a metallic material having a corrosion resistance superior to that of the aluminum material.

24. The heat exchanger of claim 1, wherein:

the first tube and the second tube are stacked with one another;

at least one of the first tube and the second tube has an inner wall forming a corresponding one of the first fluid passage and the second fluid passage, the inner wall having concave and convex portions thereon.

25. The heat exchanger of claim 1, wherein:

at least one of the first tube and the second tube is composed of a tube core member in which a corresponding one of the first fluid passage and the second fluid passage is formed, and a sacrifice layer provided on a surface of the tube core member, the sacrifice layer having an electrical potential lower than that of the tube core member.

26. A heat exchanger comprising:

a first tube defining therein a first fluid passage in which a first fluid flows;

a second tube contacting the first tube and defining therein a second fluid passage in which a second fluid flows;

an inner fin disposed in the first tube and having a plurality of segments offset-disposed with a stagger arrangement; wherein:

the first tube has a first joint surface brazed to a second joint surface of the second tube;

a groove is provided on the first joint surface to divide the first joint surface into at least two regions such that the first joint surface is brazed to the second joint surface at the regions other than the groove;

the first fluid passage defined in the first tube serpentines to cross perpendicularly a second fluid direction in which the second fluid flows in the second fluid passage;

the first tube includes a plurality of first tube bodies each contacting the second tube and each having a longitudinal direction perpendicular to that of the second tube; and the first fluid flows in each of the plurality of first tube bodies in a first fluid direction perpendicular to the second fluid direction and parallel to the longitudinal direction of each of the plurality of first tube bodies.

27. The heat exchanger of claim 26, wherein:

the inner fin includes a first fin portion disposed in a first part of the first tube and having a first group of segments arranged at a first pitch in a direction approximately perpendicular to the first fluid direction, and a second fin portion disposed in a second part of the first tube and having a second group of segments arranged at a second pitch in the direction approximately perpendicular to the first fluid direction;

the first part of the first tube is provided at an outlet side of the first tube with respect to the second part; and the first pitch is larger than the second pitch.

28. The heat exchanger of claim 26, wherein:

the inner fin includes a first fin portion disposed in a first part of the first tube and having a first group of segments, each plate surface of which is approximately perpendicular to the first fluid direction, and a second fin portion disposed in a second part of the first tube and having a second group of segments;

the first part of the first tube is provided at an outlet side of the first tube with respect to the second part.

29. The heat exchanger of claim 28, wherein the second group of segments of the second fin portion have plate surfaces approximately parallel to the first fluid direction.

30. A heat exchanger comprising:

a first tube defining a first fluid passage in which a first fluid flows;

a second tube contacting the first tube and defining therein a second fluid passage in which a second fluid flows; and an inner fin disposed in the first tube and having a plurality of segments offset-disposed with a stagger arrangement;

wherein the first tube is composed of a plurality of first tube bodies that are disposed such that the first fluid flows in the plurality of first fluid flows in the plurality of first tube bodies with a serpentine path, and such that the first fluid flows in each of the plurality of first tube bodies in a first fluid direction crossing a second fluid direction in which the second fluid flows in the second fluid passage of the second tube.

31. The heat exchanger of claim 30, wherein the plurality of first tube bodies are arranged in a direction approximately perpendicular to a longitudinal direction thereof and perpendicular to a longitudinal direction of the second tube.

32. The heat exchanger of claim 31, wherein the second tube meanders to extend in the direction in which the plurality of first tube bodies are arranged and to have a plurality of second tube portions each extending in the second fluid direction such that the second fluid flows in each of the plurality of second tube portions in the second fluid direction to form a serpentine path.

33. The heat exchanger of claim 30, wherein the plurality of first tube bodies are arranged in a longitudinal direction of the second tube.

34. The heat exchanger of claim 30, further comprising a first tube header connecting adjacent two of the plurality of first tube bodies to turn the first fluid direction at 180° between the adjacent two of the plurality of first tube bodies.

35. The heat exchanger of claim 30, wherein:

the inner fin includes a first fin portion disposed in a first part of the first tube and having a first group of segments arranged at a first pitch in a direction approximately perpendicular to the first fluid direction, and a second fin portion disposed in a second part of the first tube and having a second group of segments arranged at a second pitch in the direction approximately perpendicular to the first fluid direction;

the first part of the first tube is provided at an outlet side of the first tube with respect to the second part; and the first pitch is larger than the second pitch.

36. The heat exchanger of claim 30, wherein:

the inner fin includes a first fin portion disposed in a first part of the first tube and having a first group of segments, each plate surface of which is approximately perpendicular to the first fluid direction, and a second fin portion disposed in a second part of the first tube and having a second group of segments; and the first part of the first tube is provided at an outlet side of the first tube with respect to the second part.

37. The heat exchanger of claim 34, wherein the second group of segments of the second fin portion have plate surfaces approximately parallel to the first fluid direction.

38. The heat exchanger of claim 30, wherein:

the first fluid is water and flows in the first tube made of one of copper and stainless;

the second fluid is aluminum and flows in the second tube made of aluminum;

the first tube and the second tube are brazed to each other through a joint member having an aluminum layer and a brazing filler metal layer.

39. The heat exchanger of claim 30, wherein:

the second fluid flowing in the second tube has a temperature higher than that of the first fluid flowing in the first tube; and the second tube is exposed to a space at an opposite side of the first tube contacting the second tube, the space being provided for thermal insulation.

40. A heat exchanger comprising:

a first tube defining a first fluid passage in which a first fluid flows;

a second tube contacting the first tube and defining therein a second fluid passage in which a second fluid flows; and a reinforcement member provided at a side of a first one of the first and second tubes opposite to a second one of the first and second tubes, the first one having a flexural rigidity smaller than that of the second one, the reinforcement member being provided for increasing the flexural rigidity of the first one; wherein:

the first tube is composed of a plurality of first tube bodies that are disposed such that the first fluid flows in the plurality of first tube bodies with a serpentine path, and such that the first fluid flows in each of the plurality of first tube bodies in a first fluid direction crossing a second fluid direction in which the second fluid flows in the second fluid passage of the second tube.

41. A heat exchanger comprising:

a first tube defining a first fluid passage in which a first fluid flows;

a second tube contacting the first tube and defining therein a second fluid passage in which a second fluid flows;

an air vent member provided at an upper side of the first tube to release air from the first tube; and a fluid vent member provided at a lower side of the first tube to release the second fluid from the first tube; wherein:

the first tube is composed of a plurality of first tube bodies that are disposed such that the first fluid flows in the plurality of first tube bodies with a serpentine path, and such that the first fluid flows in each of the plurality of first tube bodies in a first fluid direction crossing a second fluid direction in which the second fluid flows in the second fluid passage of the second tube.

* * * * *